US010023205B2

(12) United States Patent
Kinugawa et al.

(10) Patent No.: US 10,023,205 B2
(45) Date of Patent: Jul. 17, 2018

(54) ARTICLE TRANSPORT FACILITY

(71) Applicant: Daifuku Co., Ltd., Osaka-shi (JP)

(72) Inventors: Tomotaka Kinugawa, Shiga (JP); Daisuke Ogawa, Shiga (JP)

(73) Assignee: Daifuku Co., Ltd., Osaka-shi (JP)

( * ) Notice: Subject to any disclaimer, the term of this patent is extended or adjusted under 35 U.S.C. 154(b) by 212 days.

(21) Appl. No.: 15/090,787

(22) Filed: Apr. 5, 2016

(65) Prior Publication Data

US 2016/0288802 A1 Oct. 6, 2016

(30) Foreign Application Priority Data

Apr. 6, 2015 (JP) ..... 2015-077896

(51) Int. Cl.
*B61B 3/02* (2006.01)

(52) U.S. Cl.
CPC ..... *B61B 3/02* (2013.01)

(58) Field of Classification Search
CPC ..... E01B 25/00; E01B 25/12; E01B 25/26; E01B 7/00; E01B 7/10; E01B 7/12; E01B 7/28; E01B 25/22; B61B 5/02; B61B 3/00; B61B 3/02
USPC ..... 104/130.07
See application file for complete search history.

(56) References Cited

U.S. PATENT DOCUMENTS 8,701,864 B2 4/2014 Ogawa et al.
2013/0313070 A1* 11/2013 Ogawa ..... B65G 35/06 198/370.01
2016/0288808 A1* 10/2016 Izumi ..... B61B 3/00

FOREIGN PATENT DOCUMENTS

JP 2013110370 A 6/2013

* cited by examiner

*Primary Examiner* — Mark T Le
(74) *Attorney, Agent, or Firm* — The Webb Law Firm

(57) ABSTRACT

First travel rail pair provided along a first path has a first discontinuous section. And second travel rail pair provided along a second path has a second discontinuous section. First guide members allow movement of guided members along a travel direction and restrict vertical movement of one or more of the guided member when the article transport vehicle travels through a crossing portion along the first path. Second guide members allow movement of the guided members along the travel direction and restrict vertical movement of one or more of the guided members when the article transport vehicle travels through a crossing portion along the second path.

16 Claims, 12 Drawing Sheets

ARTICLE TRANSPORT FACILITY

CROSS-REFERENCE TO RELATED APPLICATION

This application claims priority to Japanese Patent Application No. 2015-077896 filed Apr. 6, 2015, the disclosure of which is hereby incorporated in its entirety by reference.

FIELD OF THE INVENTION

The present invention relates to an article transport facility which comprises an article transport vehicle configured to travel along travel paths in one direction to transport an article, and a travel rail pair on which the article transport vehicle travels, the travel rail pair including two rail members arranged in parallel and spaced apart from each other at a constant distance along a width direction which is perpendicular to a direction along which a corresponding travel path extends.

BACKGROUND ART

An example of an article transport facility with travel paths including branching portions and crossing portions is disclosed in JP Publication of Application No. 2013-110370. Each travel rail pair has a left hand side rail positioned on the left hand side and a right hand side rail as seen along the travel direction of an article transport vehicle. The article transport vehicle has mounted members (such as a connecting shaft (12), and a power receiving portion (25), etc.) such that they are positioned between the left hand side rail and the right hand side rail. At a branching portion or a crossing portion, these mounted members need to cross the left hand side rail or the right hand side rail depending on the traveling direction. For example, at a branching portion, a discontinuous section in which the left hand side rail or the right hand side rail is discontinuous exists so that the mounted members do not come into contact with the left hand side rail or the right hand side rail that the mounted members need to cross.

In addition, a crossing portion has movable rails and an actuator device for moving the movable rails. The article transport vehicle includes a pair of right and left travel wheels consisting of a travel wheel that travels on the left hand side rail, and a travel wheel that travels on the right hand side rail. And the movable rails prevent both of the pair of right and left travel wheels of the article transport vehicle from leaving the rails simultaneously in a crossing portion. More specifically, the movable rails are configured to be switched between a position at which one of the movable rails is located in the discontinuous section of the left hand side rail and functions as the left hand side rail and a position at which the other of the movable rails is located in the discontinuous section of the right hand side rail and functions as the right hand side rail. When the article transport vehicle travels through the crossing portion, the positions of the movable rails are changed by means of an actuator device to prevent the mounted members mounted on the article transport vehicle from contacting the left hand side rail and/or the right hand side rail, and to keep both travel wheels from leaving the travel rail pair in the crossing portion. However, with this arrangement, it is necessary to provide the movable rails and the actuator device for moving the movable rails in the crossing portion, leading to a complex structure of the crossing portion.

SUMMARY OF THE INVENTION

Accordingly, an article transport facility is desired in which a crossing portion has a simple structure and in which a forward or backward tilting, or leaning, of the article transport vehicle when travelling through a crossing portion is reduced.

In one embodiment, an article transport facility comprises: an article transport vehicle configured to travel along travel paths to transport an article; a travel rail pair on which the article transport vehicle travels, the travel rail pair including two rail members arranged in parallel and spaced apart from each other at a constant distance along a width direction which is perpendicular to a direction along which a corresponding travel path extends; first guide members whose positions are fixed with respect to the travel rail pair; second guide members whose positions are fixed with respect to the travel rail pair; wherein the article transport vehicle includes a first travel wheel pair including a pair of right and left travel wheels which roll on travel surfaces of the travel rail pair, a second travel wheel pair located on one side with respect to the first travel wheel pair along a vehicle body fore and aft direction which is along a travel direction of the article transport vehicle, the second travel wheel pair including a pair of right and left travel wheels which roll on the travel surfaces of the travel rail pair, guided members whose vertical positions can be fixed with respect to the first travel wheel pair and the second travel wheel pair, wherein the travel paths include a first path, a second path that crosses the first path, and a crossing portion in which the first path and the second path cross each other, wherein a first travel rail pair which is the travel rail pair provided along the first path has, in the crossing portion, a first discontinuous section in which the rail members are discontinuous, wherein a second travel rail pair which is the travel rail pair provided along the second path has, in the crossing portion, a second discontinuous section in which the rail members are discontinuous, wherein the first guide members allow movement of the guided members in the travel direction and restrict vertical movement of one or more of the guided members, in a first traveling state in which the first travel wheel pair is in the first discontinuous section and in a second traveling state in which the second travel wheel pair is in the first discontinuous section, when the article transport vehicle travels through the crossing portion along the first path, and wherein the second guide members allow movement of the guided members in the travel direction and restrict vertical movement of one or more of the guided members, in a third traveling state in which the first travel wheel pair is in the second discontinuous section and in a fourth traveling state in which the second travel wheel pair is in the second discontinuous section, when the article transport vehicle travels through the crossing portion along the second path.

With this arrangement, by providing the first discontinuous section and the second discontinuous section, the article transport vehicle can travel through the crossing portion without the mounted members mounted on the article transport vehicle contacting the travel rails of the paths that cross each other. Even if the article transport vehicle includes, for example, mounted members that are located between the right and left rail members, the article transport vehicle travels through the second discontinuous section in the second travel rails when it travels through the crossing portion along the first path, and the article transport vehicle travels through the first discontinuous section in the first travel rails when it travels through the crossing portion along the first path.

When the article transport vehicle is in the first traveling state and in the second traveling state, the first guide members allow movement of the guided members in the travel direction and restrict vertical movement of one or more of the guided members. Therefore, forward or backward tilting of article transport vehicle can be restricted when the article transport vehicle travels through the crossing portion along the first path. When the article transport vehicle is in the third traveling state and in the fourth traveling state, the second guide members allow movement of the guided members in the travel direction and restrict vertical movement of one or more of the guided members. Therefore, forward or backward tilting of article transport vehicle can be restricted when the article transport vehicle travels through the crossing portion along the second path.

In addition, the first guide members and the second guide member are provided such that their positions with respect to the travel rail pair are fixed. Therefore, for example, the first guide members and the second guide members do not have to be movable, and neither is it necessary to provide an actuator device for moving these guide members. Thus, with the arrangements described above, the crossing portion has a simple structure, and forward or backward tilting, or leaning, of the article transport vehicle when travelling through the crossing portion is reduced.

Additional features and advantages of the article transport facility will become clear from the following descriptions of the embodiments described with reference to the attached drawings.

DETAILED DESCRIPTION

Figure 1:
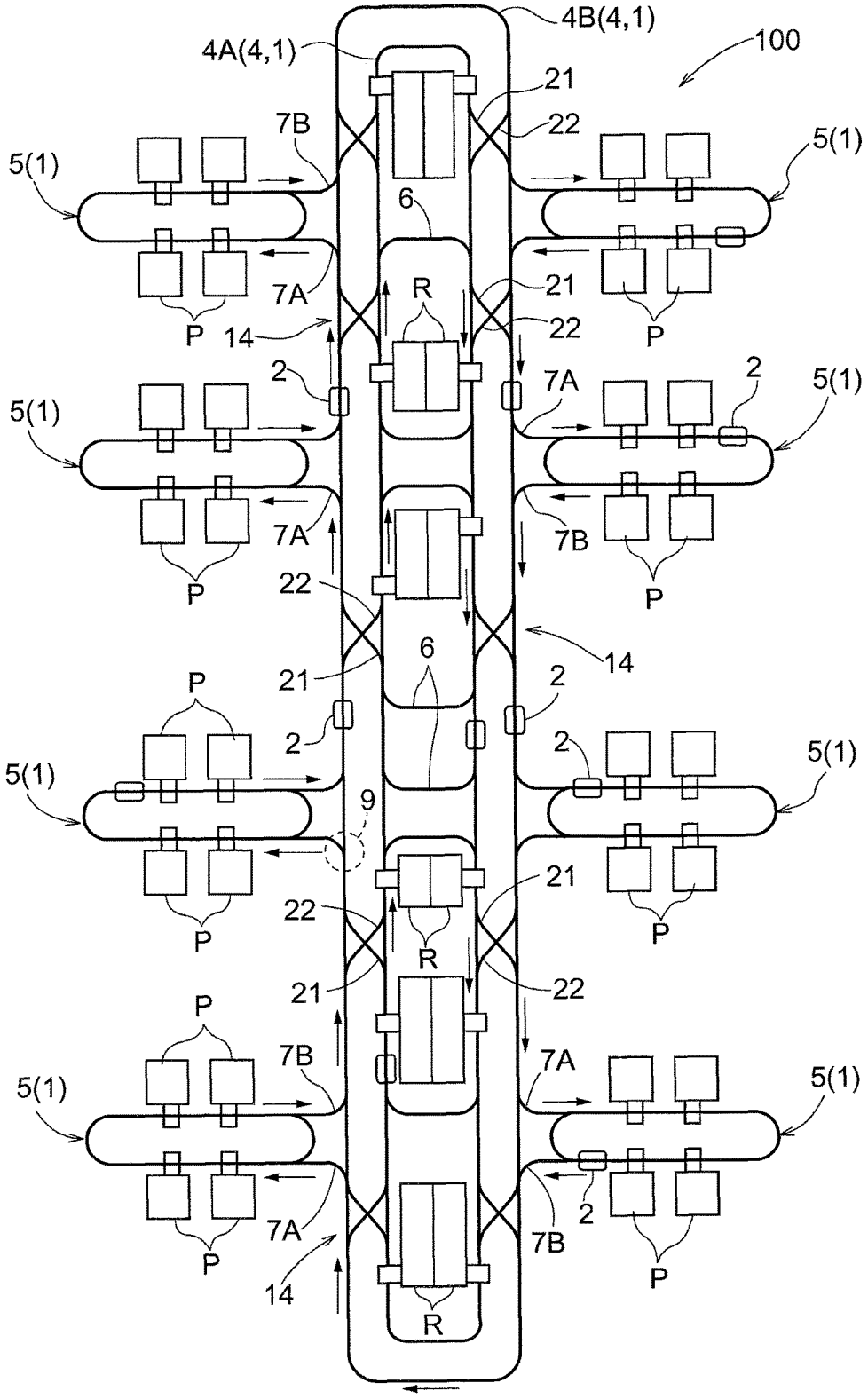
FIG. 1 shows travel paths in an article transport facility in accordance with an embodiment.

Preferable embodiments of an article transport facility 100 are described next with reference to the drawings. An article transport facility 100 includes article transport vehicles 2 which travels only in one direction (advancing direction, or travel direction, of the article transport vehicles 2) as shown with arrows in FIG. 1 along travel paths 1 to transport articles, and travel rail pairs 3 (see FIGS. 2 and 3, etc.) along which the article transport vehicle 2 travel. Each travel rail pair 3 consists of two parallel rail members 3*w* that are spaced apart from each other along a direction (a path width direction X, or a width direction) that is horizontal and is perpendicular to a direction along which the travel path extends (path extending direction Y). As shown in FIG. 3, the rail members in each travel rail pair 3 are connected to each other by rail connecting members 35 each formed in an inverted U-shape as seen along the path extending direction Y and are suspended and supported by the ceiling through support members 80. In the present embodiment, each article to be transported 90 is a FOUP (Front Opening Unified Pod) for holding semiconductor substrates. In addition, as shown in FIG. 1, the article transport facility 100 includes storage locations R for storing FOUPs as articles 90, and article processors P which perform various operations on the semiconductor substrates carried by the FOUPs.

In the following description, the direction along which the article transport vehicle 2 travels along the travel path 1, i.e., the fore and aft direction of the article transport vehicle 2 will be referred to as the vehicle body fore and aft direction YY. Since the article transport vehicle 2 travels along the travel path 1, the vehicle body fore and aft direction YY coincides approximately with the path extending direction Y (or the path longitudinal direction). In addition, the direction that is horizontal and is perpendicular (i.e., perpendicular in plan view) to the vehicle body fore and aft direction YY, that is, the lateral direction of the article transport vehicle 2 will be referred to as the vehicle body lateral direction XX. As described above, the direction that is horizontal and is perpendicular (i.e., perpendicular in plan view) to the path extending direction Y is referred to as the path width direction X. As with the relationship between the vehicle body fore and aft direction YY and the path extending direction Y, the vehicle body lateral direction XX coincides approximately with the path width direction X. Note that the path width direction X is also the direction along which the rail members 3*w* are spaced apart from each other since the right and left rail members 3*w* that constitute each travel rail pair 3 are installed parallel to each other. In addition, unless specifically stated otherwise, for both the path width direction X and the vehicle body lateral direction XX, the right and left directions (left direction XL and right direction XR) are defined to be those as seen from behind the article transport vehicle 2 toward the front, or the advancing direction, of the article transport vehicle 2.

As shown in FIG. 1, the travel paths 1 include two loop-shaped primary paths 4 (4A, 4B), and a plurality of loop-shaped secondary paths 5 each of which branches or splits off from a primary path 4, and joins or merges into the primary path 4. Each secondary path 5 extends by way of a plurality of article processors P after branching off from the primary path 4 and before merging into the primary path 4. The two loop-shaped primary paths 4 are provided such that one loop is placed within another, or the other, so that one primary path 4 (first primary path 4A) is surrounded by the other primary path 4 (second primary path 4B). Since the first primary path 4A and the second primary path 4B are installed approximately parallel to each other in the present embodiment, the path width direction X is also the "paths spaced-apart direction" along which the first primary path 4A and the second primary path 4B are spaced apart from each other. In other words, the two primary paths 4 are installed such that they are spaced apart from each other along the path width direction X (paths spaced-apart direction). The article transport vehicles 2 travel around the two primary paths 4 in the same direction (clockwise direction). Note that, in FIG. 1, the travel directions of the article transport vehicles 2 are indicated by the arrows. In the present embodiment, each of the two loop-shaped primary paths 4 is formed to have a shape of a rectangle with a high aspect ratio in plan view and with a circular arc portion at each of the four corners.

The second primary path 4B, which is an outside path of the two primary paths 4, is connected to the plurality of the secondary paths 5. For this reason, the travel paths 1 include branching connecting paths 7A each of which allows the article transport vehicles 2 to perform a branching travel from the second primary path 4B into a secondary path 5, and merging connecting paths 7B each of which allows the article transport vehicles 2 to perform a merging travel from a secondary path 5 into the second primary path 4B. In addition, the two primary path 4 are also connected to each other so that the article transport vehicles 2 can change paths between the first primary path 4A and the second primary path 4B. The travel paths 1 include first connecting paths 21 and second connecting paths 22 such that they are located between the first primary path 4A and the second primary path 4B, along the path width direction X (paths spaced-apart direction). Each of the first connecting paths 21 is a path by means of which the article transport vehicle 2 travels from the first primary path 4A to the second primary path 4B. Each of the second connecting paths 22 is a path by means of which the article transport vehicle 2 travels from the second primary path 4B to the first primary path 4A.

Each first connecting path 21 and each second connecting path 22 are connected to the primary paths 4 at a slanted angle in plan view. In addition, each first connecting path 21 and a corresponding second connecting path 22 cross each other in plan view. As described above, article transport vehicles 2 travel from the first primary path 4A to the second primary path 4B along a first connecting path 21 whereas article transport vehicles 2 travel from the second primary path 4B to the first primary path 4A along a second connecting path 21. Therefore, each location at which a first connecting path 21 and a second connecting path 22 cross each other is a path changing portion 14 in which article transport vehicles 2 change paths between the first primary path 4A and the second primary path 4B. As shown in FIG. 1, such path changing portions 14 are provided at a plurality of locations along the longitudinal direction of the primary paths 4. The specific structure of the path changing portion 14 is described later.

In addition, the travel paths 1 also include shortcut paths 6 as shown in FIG. 1. These shortcut paths 6 are provided as bypass routes for the first primary path 4A that is the inner path of the primary paths 4. As described above, the two primary paths 4 are generally rectangular in shape with a high aspect ratio in plan view. Each shortcut path 6, which functions as a bypass route, connects one and the other of the two long sides of the first primary path 4A to each other along the path width direction X. The article transport vehicles 2 can shorten their travel distances by traveling through the shortcut paths 6 depending on their destinations. The shortcut paths 6 are provided at a plurality of locations along the long sides of the generally rectangular first primary path 4A.

A plurality of storage locations R are provided on the inside of the first primary path 4A which is the inside path of the two primary paths 4. In other words, the first primary path 4A is a path that extends by way of a plurality of storage locations R. The first primary path 4A is used as a path for article transfer along which the article transport vehicles 2 are stopped to transfer articles 90 to and from the storage locations R. In addition, the second primary path 4B which is the other of the two primary paths 4 is used as a path for continuous traveling along which the article transport vehicles 2 travel continuously.

Figure 2:
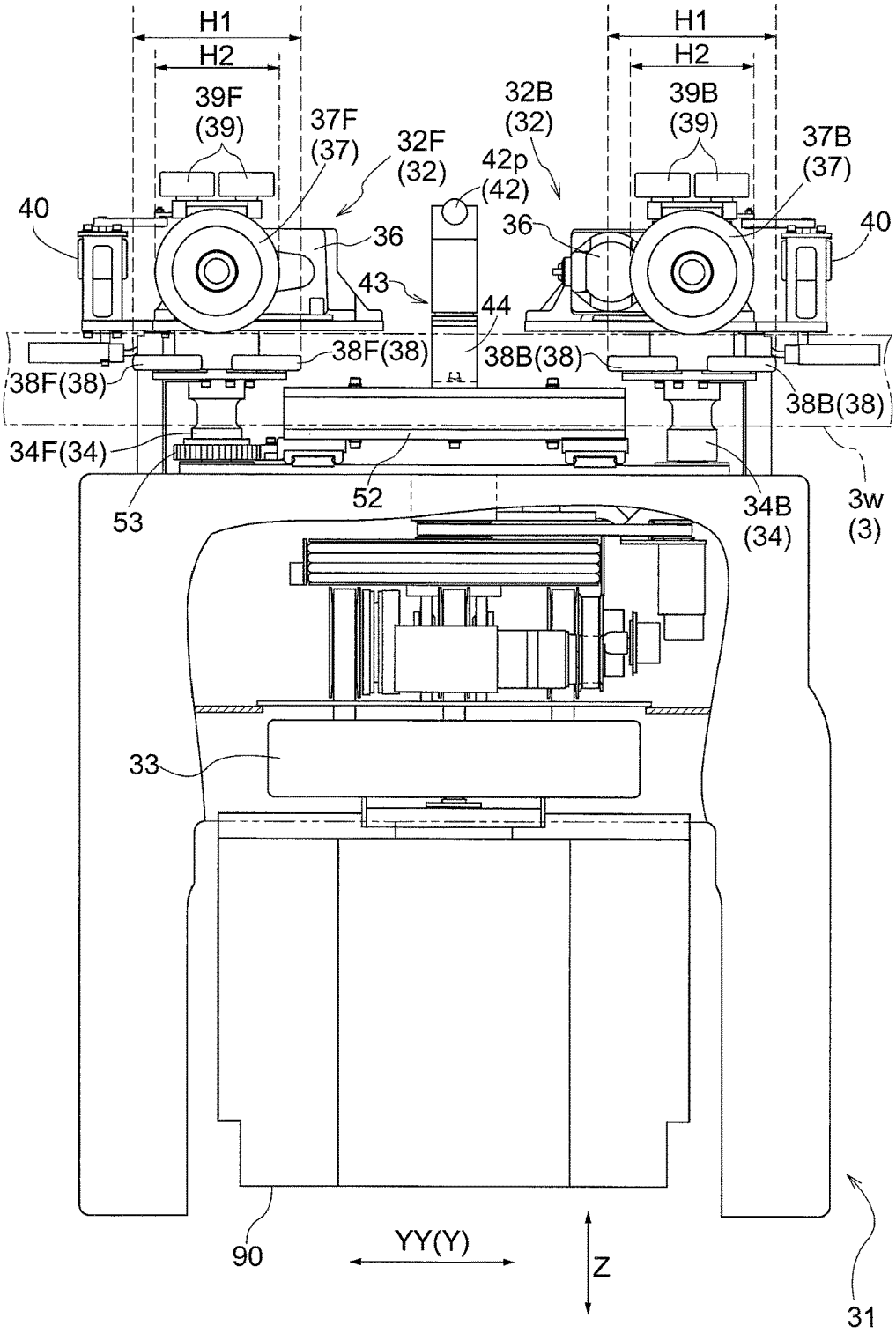
FIG. 2 is a side view of an article transport vehicle.
Figure 3:
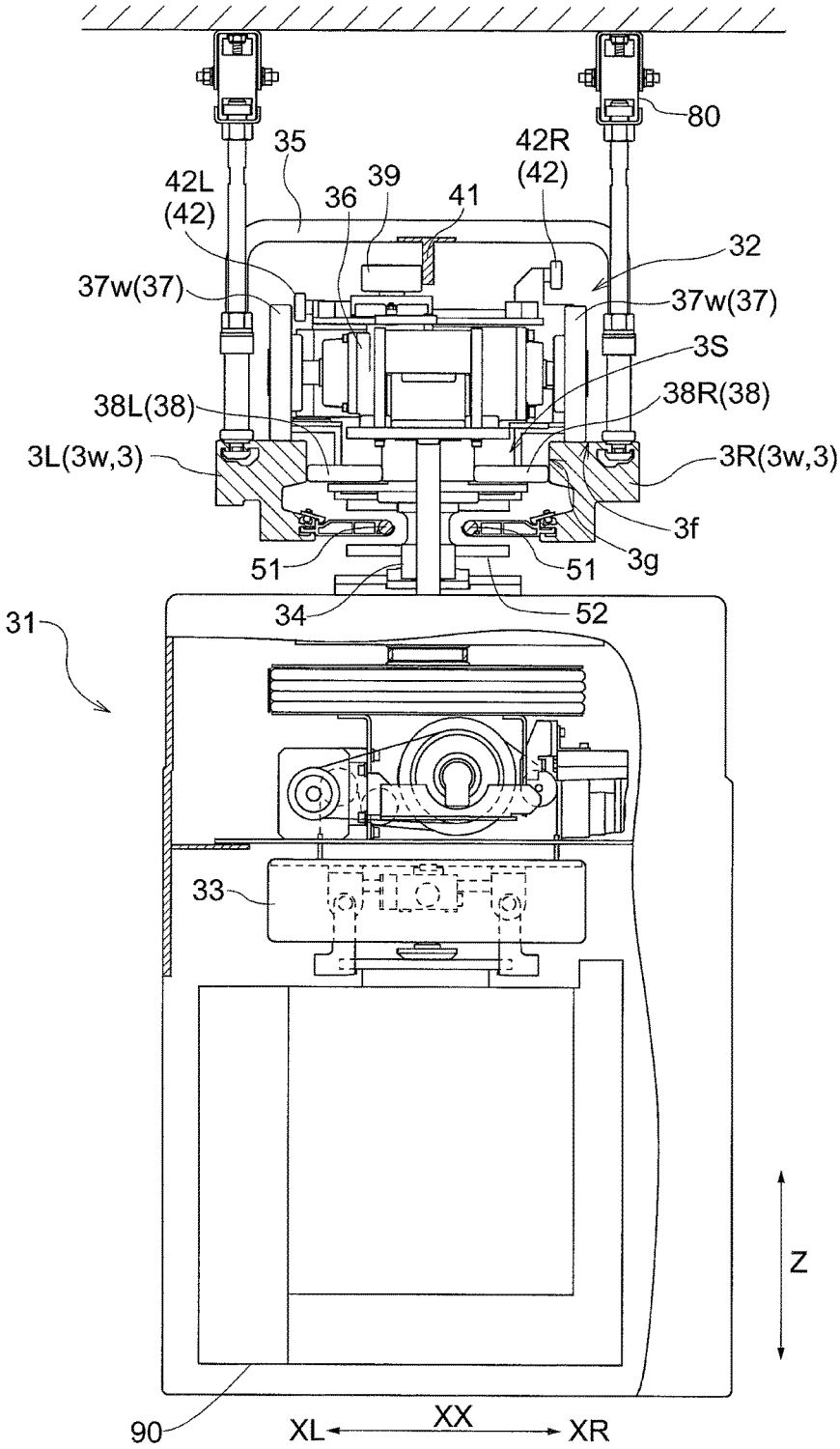
FIG. 3 is a rear view of the article transport vehicle.

As shown in FIGS. 2 and 3, each article transport vehicle 2 includes a travel portion 32, a vehicle main body 31 (article holding portion), and connecting portions 34. The travel portion 32 travels on, and along, the travel rail pair 3. The vehicle main body 31 is located below the travel rail pair 3, and holds an article. Each connecting portion 34 is positioned between the two rail members 3*w* that constitute the travel rail pair 3, and connects the travel portion 32 and the vehicle main body 31 to each other. The vehicle main body 31 includes a support portion 33 which supports an article with the article suspended therefrom. The travel portion 32 consists of a front travel portion 32F and a back travel portion 32B. The front travel portion 32F and the back travel portion 32B are spaced apart from each other along the vehicle body fore and aft direction YY. In addition, the connecting portions 34 also consist of a front connecting portion 34F and a back connecting portion 34B which correspond to the front and back pair of the travel portions 32 (32F, 32B). The vehicle main body 31 is connected to each of the front and back connecting portions 34 (34F, 34B) such that the vehicle main body 31 can rotate or pivot about a vertical axis with respect to the front connecting portion 34F and also about a vertical axis with respect to the back connecting portion 34B. The front travel portion 32F and the front connecting portion 34F are fixedly connected to each other, and the back travel portion 32B and the back connecting portion 34B are fixedly connected to each other. Therefore, the front travel portion 32F and the front connecting portion 34F are integrally pivoted or rotated about a vertical axis with respect to the vehicle main body 31. And the back travel portion 32B and the back connecting portion 34B are also integrally pivoted or rotated to about a vertical axis with respect to the vehicle main body 31.

The front travel portion 32F includes a travel wheel pair 37 (which may be referred to hereinafter as the front wheel pair 37F) consisting of a pair of right and left travel wheels 37*w* (see FIG. 3, etc.) and guide wheel pairs 38 (front guide wheel pairs 38F (first guide wheel pairs)) with each guide wheel pair 38 consisting of a pair of right and left guide wheels (a right guide wheel 38R, and a left guide wheel 38L: See FIG. 3). Note that two sets of the guide wheel pair 38 are provided to the front travel portion 32F with one set located behind the other along the vehicle body fore and aft direction YY. Therefore, the front guide wheel pairs 38F include a total of four rotating bodies (guide wheels). The back travel portion 32B also has one set of travel wheel pair 37 (may be referred to hereinafter as the rear wheel pair 37B) and two sets of guide wheel pairs 38, as with the case of the front travel portion 32F. An example is described in the present embodiment in which each of the front travel portion 32F and the back travel portion 32B has two sets of guide wheel pair 38; however, each may, of course, have only one set of guide wheel pair 38.

The travel wheel pairs 37 are driven and rotated by respective electric-powered actuating motors 36 and travel on the travel surfaces 3*f* defined by the top surfaces of the travel rail pair 3. In addition, each rotating body (each guide wheel) of the guide wheel pairs 38 is free to rotate about an axis that extends along the vehicle body vertical direction Z (i.e., about a vertical axis), and is in contact with, and is thus rotated on, the corresponding one of the inward surfaces 3*g* (of the rail members 3*w* of the travel rail pair 3) which face each other. Note that the guide wheel pairs 38 are provided to the front travel portion 32F and to the back travel portion 32B such that the two rotating bodies (guide wheels) in each pair are spaced apart from each other with a connecting portion 34 (the front connecting portion 34F or the back connecting portion 34B) located therebetween along the vehicle body lateral direction XX. In other words, each guide wheel pair 38 has a left guide wheel 38L in contact with the inward surface 3*g* of the left rail member 3L, and a right guide wheel 38R in contact with the inward surface 3*g* of the right rail member 3R.

The two sets of the guide wheel pair 38 (front guide wheel pairs 38F) provided to the front travel portion 32F are located such that the range H2 over which the front wheel pair 37F (first travel wheel pair) is located, or extends, along the vehicle body fore and aft direction YY overlaps with at least a part of the range H1 over which the two sets of the front guide wheel pair 38F are located, or extend, along the vehicle body fore and aft direction YY. The two sets of the guide wheel pair 38 (back guide wheel pairs 38B) provided to the back travel portion 32B are located such that the range H2 over which the rear wheel pair 37B (second travel wheel pair) is located, or extends, along the vehicle body fore and aft direction YY overlaps with at least a part of the range H1 over which the two sets of the back guide wheel pairs 38B are located, or extend, along the vehicle body fore and aft direction YY.

As described above, as the travel wheel pairs 37 for travelling on the top surfaces (travel surfaces 3*f*) of the travel rail pair 3, the article transport vehicle 2 has the front wheel pair 37F (which is the first travel wheel pair) and the rear wheel pair 37B (which is the second travel wheel pair) located on one side along the vehicle body fore and aft direction YY of the article transport vehicle 2 with respect to the front wheel pair 37F, with one pair spaced apart from the other pair along the vehicle body fore and aft direction YY. In addition, the connecting portions 34 are located between the guide wheel pairs 38 along, or with respect to, the vehicle body lateral direction XX of the article transport vehicle 2.

A power receiving portion 52, to which driving electric power is supplied without contact by the electricity supply lines 51 installed along the travel rail pair 3, is provided on the top surface of the vehicle main body 31. As shown in FIG. 2, this power receiving portion 52 is located between the front connecting portion 34F and the back connecting portion 34B in a side view (i.e., as seen along the vehicle body lateral direction XX). In addition, as shown in FIG. 3, the power receiving portion 52 is positioned in connecting space 3S defined by the travel rail pair 3. As shown in FIG. 2, the power receiving portion 52 is supported by the top surface of the vehicle main body 31 such that it can slide and move along the vehicle body lateral direction XX. The front travel portion 32F and the power receiving portion 52 are operatively connected to each other by an operatively connecting mechanism 53. And the power receiving portion 52 is caused to slide and move along the vehicle body lateral direction XX in synchronization with a pivoting of front travel portion 32F about the vertical axis with respect to the vehicle main body 31.

The article transport vehicle 2 travels along a travel path 1 with its position along the vehicle body lateral direction XX restricted by virtue of the fact that the travel wheel pairs 37 are drivingly rotated and the fact that the guide wheel pairs 38 of the front travel portion 32F and the back travel portion 32B are guided by the inward surfaces 3*g* of the travel rail pair 3. In addition, the article transport vehicle 2 can travel along the travel path 1 even where the travel path 1 is curved because the front travel portion 32F and the back travel portion 32B can pivot with respect to the vehicle main body 31 by virtue of the fact that each connecting portion 34 can be rotated or pivoted with respect to the vehicle main body 31 about an axis extending along the vehicle body vertical direction Z.

Figure 6:
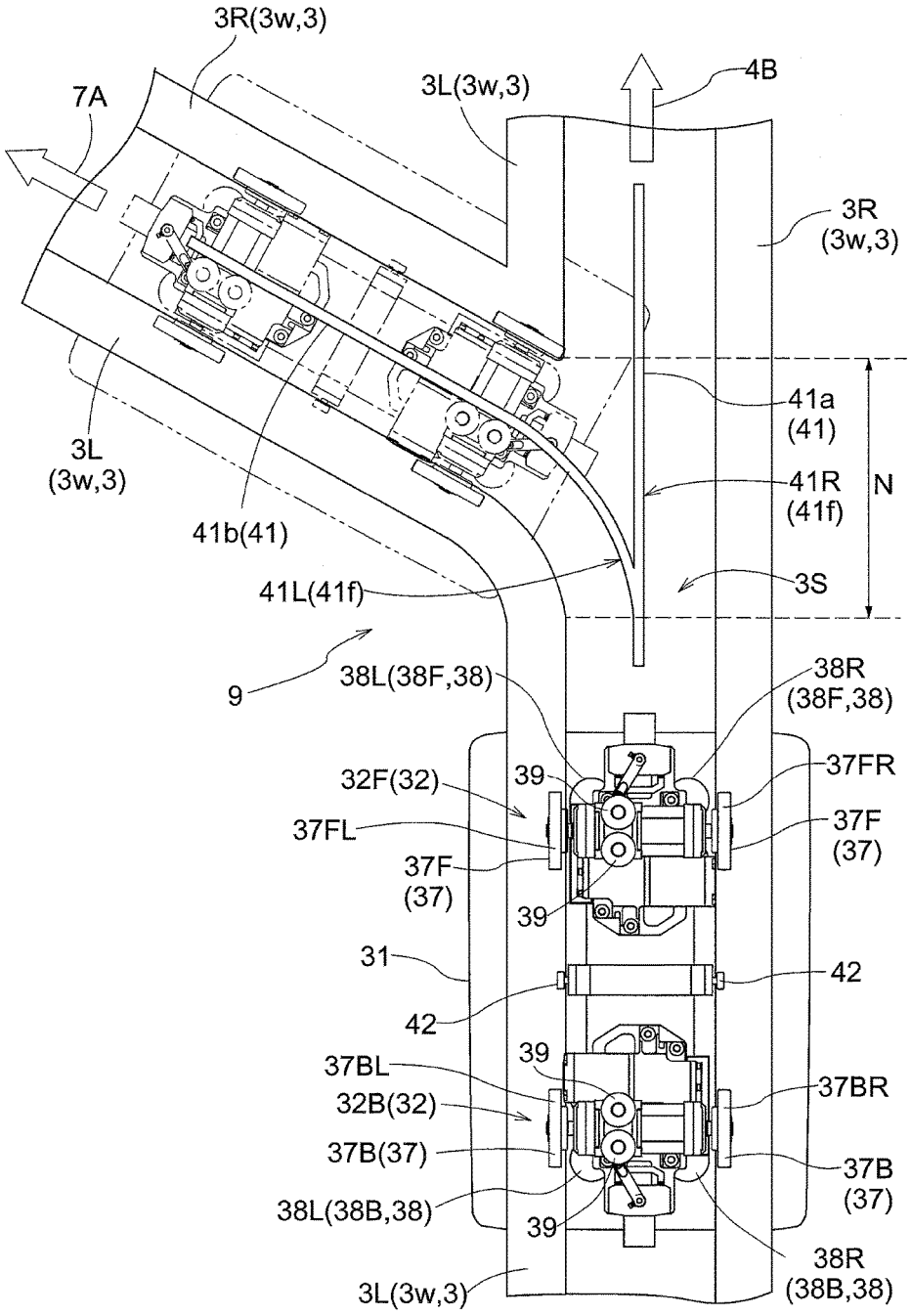
FIG. 6 is a plan view of a branching connecting portion.

Between the two rail members 3*w* that are installed such that they are spaced apart from each other along the path width direction X, connecting space 3S is formed that allows the space above the travel rail pair 3 and the space below to be connected or in communication, to each other. The connecting portions 34 and the guide wheel pairs 38 are located in the connecting space 3S. The connecting space 3S is formed to extend continuously along the travel path 1. In addition, at locations where two paths are connected to, or cross, each other, the connecting space 3S formed along one path is connected to the connecting space 3S formed along the other path. For example, in the branching connecting portion 9 shown in FIG. 1 with a dashed circle, the connecting space 3S formed along the second primary path 4B is connected to the connecting space 3S formed along the path that branches off into the secondary path 5. FIG. 6 shows an example of such a branching connecting portion 9. In this example, the connecting space 3S formed along the second primary path 4B is connected to the connecting space 3S formed along the branching connecting path 7A. Thus, locations where two paths are connected to, or cross each other, the connecting space 3S formed along one path is connected to the connecting space 3S formed along the other path.

In addition, the travel rail pair 3 is installed continuously along any given travel path 1; however, at locations where two paths are connected to, or cross, each other, there is a discontinuous section N in which at least one rail member 3*w* of the travel rail pair 3 installed along the path forms a gap and is thus discontinuous. Note that the rail member 3*w* forms a gap along the path extending direction Y at a gap location specified in advance. For example, in the example of the branching connecting portion 9 shown in FIG. 6, one rail member 3*w* (rail member 3*w* on the side of the branching connecting path 7A (or the left rail member 3L)) of the travel rail pair 3 installed along the first primary path 4A forms a gap along the path extending direction Y to allow two connecting space 3S to be connected to each other.

As shown in FIGS. 2 and 3, the front travel portion 32F has, at a location above the travel wheel pair 37, a front and back guide auxiliary wheel pair 39 (front guide auxiliary wheel pair 39F) which rotate about respective axies extending along the vehicle body vertical direction Z, and a guide auxiliary actuator 40 for moving the guide auxiliary wheel pair 39 together along the vehicle body lateral direction XX. The back travel portion 32B also has, as in the case of the front travel portion 32F, a guide auxiliary wheel pair 39 (back guide auxiliary wheel pair 39B) and a guide auxiliary actuator 40. Note that the guide auxiliary wheel pairs 39 (the front guide auxiliary wheel pair 39F and the back guide auxiliary wheel pair 39B) are, or correspond to, the branching guided member provided to the travel portion 32.

Figure 4:
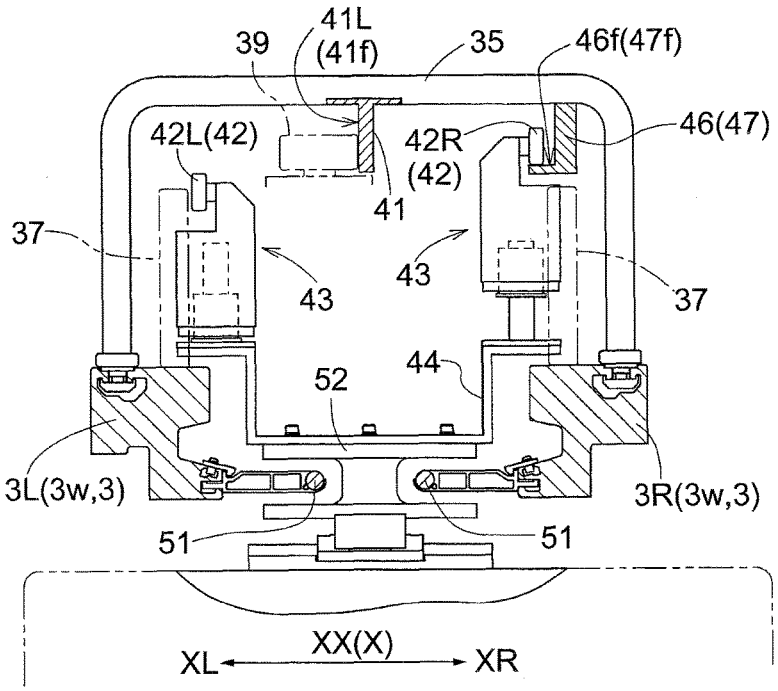
FIG. 4 shows a state in which a right hand side travel auxiliary wheel is in an upper position and a left hand side travel auxiliary wheel is in a lower position.
Figure 5:
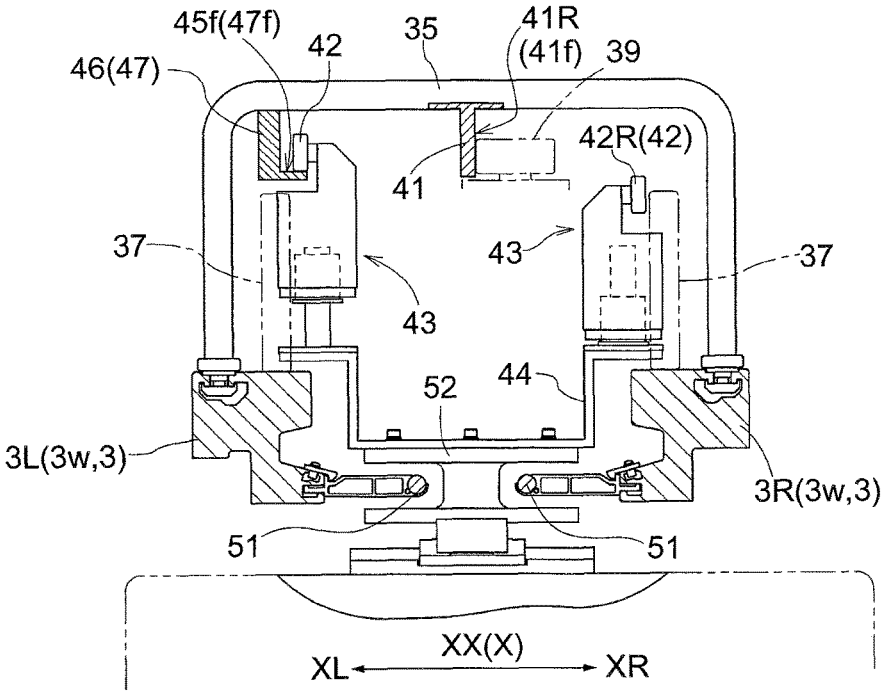
FIG. 5 shows a state in which the right hand side travel auxiliary wheel is in the lower position and the left hand side travel auxiliary wheel is in the upper position.

As shown in FIGS. 3-6, a guide rail 41 for guiding the guide auxiliary wheel pair 39 is provided in each connecting portion in which two paths are connected to each other in a travel path 1 (such as a branching connecting portion 9 in which the second primary path 4B and the branching connecting path 7A are connected to each other), and in each path changing portion 14. This guide rail 41 is located above the travel rail pair 3 and above the travel wheel pair 37 which roll on the travel rail pair 3 as shown in FIG. 3-FIG. 5, and is located in a central area between the two rail members 3*w* of the travel rail pair 3 in plan view as shown in FIG. 6.

The front travel portion 32F is configured to move the position of the guide auxiliary wheel pair 39 between a right guiding position (see FIG. 5) and a left guiding position (see FIG. 4) by moving the guide auxiliary wheel pair 39 along the vehicle body lateral direction XX with the guide auxiliary actuator 40. When in the right guiding position (see FIG. 5), the guide auxiliary wheel pair 39 is located to the right of the center of the front travel portion 32F (or in the right direction XR) along the vehicle body lateral direction XX, and contacts the guide rail 41 from the right hand side. When in the left guiding position (see FIG. 4), the guide auxiliary wheel pair 39 is located to the left of the center of the front travel portion 32F (or in the left direction XL) along the vehicle body lateral direction XX, and contacts the guide rail 41 from the left hand side. The back travel portion 32B is also configured, as in the case of the back travel portion 32F, to move the position of the guide auxiliary wheel pair 39 between a right guiding position and a left guiding position by moving the guide auxiliary wheel pair 39 along the vehicle body lateral direction XX with the guide auxiliary actuator 40.

The front guide auxiliary wheel pair 39F and the back guide auxiliary wheel pair 39B are moved in synchronization to respective guiding positions on the same side. In addition, movement of the guide auxiliary wheel pairs 39 to the right XR beyond the right guiding position, or to the left XL beyond the left guiding position is restricted or prevented by means of a restricting portion (not shown). Thus, for example, even if the pair 39 is pushed to the right XR by the guide rail 41 when the guide auxiliary wheel pair 39 is in the right guiding position, the guide auxiliary wheel pair 39 is maintained in the right guiding position by the restricting action of the restricting portion. However, if and when the pair 39 is pushed to the left XR by the guide rail 41 when the guide auxiliary wheel pair 39 is in the right guiding position, the guide auxiliary wheel pair 39 would move toward the left guiding position. The same is true (with right and left reversed) when the guide auxiliary wheel pair 39 is in the left guiding position. Although the guide auxiliary wheel pair 39 cannot be moved to the left XL, it can be moved to the right XR.

As shown in FIGS. 2-5, the article transport vehicle 2 includes a travel auxiliary wheel pair 42*p* that functions as a pair of right and left auxiliary wheels which rotate about axes extending along the vehicle body lateral direction XX, and two travel auxiliary actuators 43 for independently raising and lowering respective ones of the right and left travel auxiliary wheels 42 (i.e., the left travel auxiliary wheel 42L, and the right travel auxiliary wheel 42R) of the travel auxiliary wheel pair 42*p*. The travel auxiliary wheel pair 42*p* and the travel auxiliary actuator 43 are supported by the power receiving portion 52 through the support member 44 so as to be located at a middle position between the front wheel pair 37F and the rear wheel pair 37B as seen along the vehicle body lateral direction XX as shown in FIG. 2 and above the travel rail pair 3 as shown in FIGS. 2-5. Note that the travel auxiliary wheel pair 42*p* is, or correspond to, the guided member whose vertical position can be fixed with respect to the front wheel pair 37F and the rear wheel pair 37B and that the travel auxiliary actuators 43 are, or correspond to, the raising and lowering actuators.

As shown in FIGS. 7-10, at each path changing portion 14 in the travel path 1, a pair of right and left first auxiliary rail pair 46 that functions as first guide members on which the travel auxiliary wheel pair 42*p* rolls and a second auxiliary rail pair 47 that functions as a pair of right and left second guide members are provided. As shown in FIGS. 4 and 5, each of these first auxiliary rail pair 46 and the second auxiliary rail pair 47 is provided such that their positions are fixed with respect to the travel rail pair 3. In addition, each of the first auxiliary rail pair 46 and the second auxiliary rail pair 47 is disposed at a higher position than the travel rail pair 3 located in the path changing portion 14 and than the front wheel pair 37F and the rear wheel pair 37B of the article transport vehicle 2.

In addition, each of the first auxiliary rail pair 46 and the second auxiliary rail pair 47 are disposed such that the travel surfaces 46*f*, 47*f* of the first auxiliary rail pair 46 and the second auxiliary rail pair 47 are located below the bottom ends of the travel auxiliary wheels 42 whose vertical positions are fixed after being raised to their upper positions when the article transport vehicle 2 is located in a path changing portion 14. Note that the height or vertical position of the horizontal travel surfaces (i.e., the first auxiliary travel surface 46*f* and the second auxiliary travel surface 47*f*) of the first auxiliary rail pair 46 and the second auxiliary rail pair 47 on which the travel auxiliary wheel pair 42*p* rolls falls within the vertical width of the vertical guide surface (i.e., auxiliary guide surface 410 of the guide rail 41 on which the guide auxiliary wheel pairs 39 roll. As shown in FIGS. 4 and 5, etc., the first auxiliary rail pair 46 and the second auxiliary rail pair 47 are installed at almost the same height as the guide rail 41.

Each of the travel auxiliary actuators 43 is configured to raise and lower the travel auxiliary wheel 42, to a lower position at which the travel auxiliary wheel 42 is fixed, or held immobile, at a lower position than the first auxiliary rail pair 46 and the second auxiliary rail pair 47 (see the position of the left travel auxiliary wheel 42L in FIG. 4 and of the right travel auxiliary wheel 42R in FIG. 5), and to an upper position at which the travel auxiliary wheel 42 is fixed, or held immobile, at a higher position than the first auxiliary rail pair 46 and the second auxiliary rail pair 47 (i.e., higher position than the auxiliary travel surface 46*f* and the second auxiliary travel surface 47*f*: see the position of the right travel auxiliary wheel 42R in FIG. 4 and of the left travel auxiliary wheel 42L in FIG. 5).

Traveling of the article transport vehicle 2 in a connecting portion is described next, using a branching connecting portion 9 at which the second primary path 4B is connected to a branching connecting path 7A as an example. As shown in FIG. 6, installed as the guide rail 41 in the branching connecting portion 9 are a primary path guide rail 41*a* installed along the second primary path 4B, and a branching path guide rail 41*b* installed along the branching connecting path 7A. In addition, the left hand side rail member 3*w* (left rail member 3L) of the travel rail pair 3 installed along the second primary path 4B has a discontinuous section N in which the rail member 3*w* forms a gap along the path extending direction Y so as to allow the connecting portion 34 and the guide wheel pair 38 to pass through when the article transport vehicle 2 carries out a branching travel into the left hand side branching connecting path 7A from the second primary path 4B (i.e., when the article transport vehicle 2 takes, or travels into, the left hand side branching connecting path 7A from the second primary path 4B).

If the article transport vehicle 2 traveling along the second primary path 4B enters the branching connecting portion 9 with the two sets of the guide auxiliary wheel pair 39 (simply referred to, hereinafter, as the guide auxiliary wheel pairs 39) moved to the right guiding position, the article transport vehicle 2 travels with the guide auxiliary wheel pairs 39 located on the right hand side of the primary path guide rail 41*a*. In other words, the article transport vehicle 2 travels straight forward through the branching connecting portion 9 without the guide auxiliary wheel pairs 39 being guided by the branching path guide rail 41*b*. However, when the article transport vehicle 2 travels straight forward in the branching connecting portion 9 of the second primary path 4B, a condition occurs in which the left hand side travel wheels 37*w* (left front wheel 37FL, and left rear wheel 37BL) of the travel wheel pairs 37 are not supported by the left rail member 3L in the discontinuous section N. However, the primary path guide rail 41*a* is provided in the discontinuous section N. Because the guide auxiliary wheel pair 39 is in contact with the right hand side (right auxiliary guide surface 41R) of the primary path guide rail 41*a*, tilting, or leaning, of the article transport vehicle 2 toward left is restricted or prevented. Note that, when the article transport vehicle 2 travels straight forward in the branching connecting portion 9 of the second primary path 4B, a condition occurs in which the left guide wheels 38L of the guide wheel pairs 38 are not guided by the left rail member 3L in the discontinuous section N. However, as described above, the guide auxiliary wheel pair 39 come into contact with the right hand side (right auxiliary guide surface 41R) of the primary path guide rail 41*a* to replace the guiding action of the left guide wheels 38L. Therefore, the travel portion 32 is guided along the second primary path 4B with any movement along the vehicle body lateral direction XX being restricted or prevented by the guide auxiliary wheel pair 39 and the right guide wheels 38R.

On the other hand, as shown in FIG. 6, if the article transport vehicle 2 traveling along the second primary path 4B enters the branching connecting portion 9 with the guide auxiliary wheel pairs 39 moved to the left guiding position, the article transport vehicle 2 travels with the guide auxiliary wheel pairs 39 located on the left hand side of the branching path guide rail 41*b*. Thus, the article transport vehicle 2 carries out a branching travel into the branching connecting portion 9 with the guide auxiliary wheel pair 39 being guided by the branching path guide rail 41*b*. When the article transport vehicle 2 carries out such branching travel in the branching connecting portion 9, the right travel wheels 37*w* (the right front wheel 37FR and the right rear wheel 37BR) of the travel wheel pairs 37 pass through above the connecting space 3S formed between the rail members 3*w* of the second primary path 4B. Therefore, a condition occurs in which the right hand side travel wheels 37*w* (37FR, 37BR) are not supported by any rail member 3*w*. However, the branching path guide rail 41*b* is provided in the connecting space 3S. Because the guide auxiliary wheel pair 39 come into contact with the left hand side (left auxiliary guide surface 41L) of the branching path guide rail 41*b*, tilting, or leaning, of the article transport vehicle 2 toward right is restricted or prevented. Note that, when the article transport vehicle 2 carries out the branching travel in the branching connecting portion 9, a condition occurs in which the right guide wheels 38R of the guide wheel pairs 38 are not guided by the right rail member 3R. However, as described above, the guide auxiliary wheel pair 39 come into contact with the left hand side (left auxiliary guide surface 41L) of the branching path guide rail 41*b* to replace the guiding action of the right guide wheels 38R. Therefore, the travel portion 32 is guided from the second primary path 4B into the branching connecting path 7A with movement along the vehicle body lateral direction XX being restricted or prevented by the guide auxiliary wheel pair 39 and the left guide wheels 38L.

Figure 7:
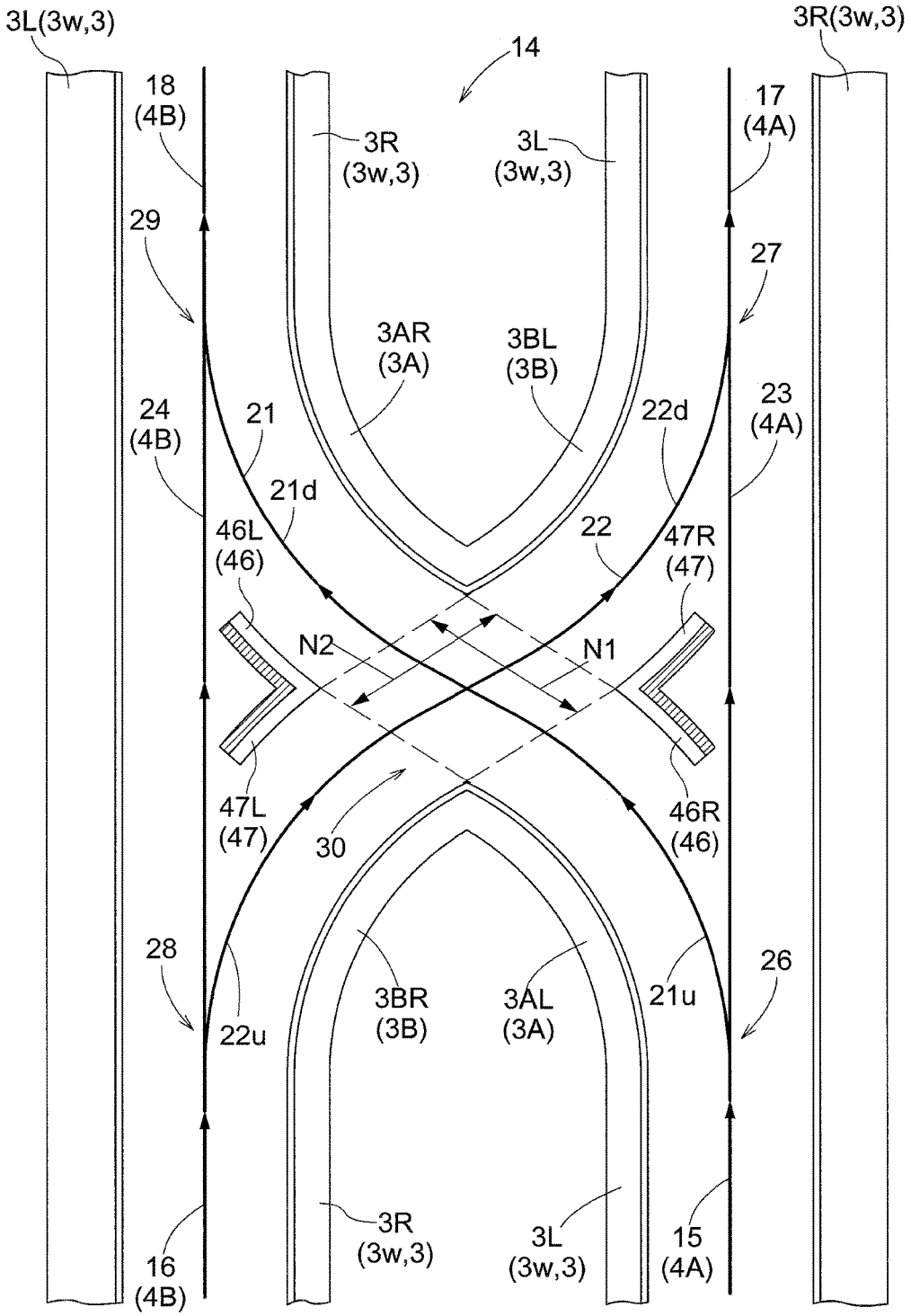
FIG. 7 is an explanatory drawing of travel paths in a crossing portion.

The path changing portions 14 are described next. As shown in FIG. 7, a first connecting path 21 (first path) is connected to a first branching portion 26 (first connecting portion) of the first primary path 4A and to a first merging portion 29 (second connecting portion) of the second primary path 4B, and is a path by which the article transport vehicle 2 travels from the first branching portion 26 toward the first merging portion 29. A second connecting path 22 (second path) is connected to a second branching portion 28 (third connecting portion) of the second primary path 4B and to a second merging portion 27 (fourth connecting portion) of the first primary path 4A, and is a path by which the article transport vehicle 2 travels from the second branching portion 28 toward the second merging portion 27. The first connecting path 21 and the second connecting path 22 cross each other. And the crossing location will be referred to as a crossing portion 30. The crossing portion 30 is located between the first primary path 4A and the second primary path 4B.

In the description of the path changing portion 14, the portion of the first primary path 4A from the first branching portion 26 to the second merging portion 27 will be referred to as the third connecting path 23. And the portion of the first primary path 4A that is upstream of the first branching portion 26 will be referred to as the first upstream path 15. The portion of the first primary path 4A that is downstream of the second merging portion 27 will be referred to as the first downstream path 17. Also, the portion of the second primary path 4B from the second branching portion 28 to the first merging portion 29 will be referred to as the fourth connecting path 24. And the portion of the second primary path 4B that is upstream of the second branching portion 28 will be referred to as the second upstream path 16. The portion of the second primary path 4B that is downstream of the first merging portion 29 will be referred to as the second downstream path 18.

Regarding the travel rail pair 3 installed along the first connecting path 21, its portion in the upstream portion (21*u*) of the first connecting path 21 includes only the left rail member 3L (referred to hereinafter as the first left travel rail 3AL) located on the left hand side of the article transport vehicle 2 traveling along the first connecting path 21 whereas its portion in the downstream portion (21*d*) of the first connecting path 21 includes only the right rail member 3R (referred to hereinafter as the first right travel rail 3AR) located on the right hand side of the article transport vehicle 2 traveling along the first connecting path 21. Note that the first left travel rail 3AL and the first right travel rail 3AR form the first travel rail pair 3A which is the travel rail pair 3 installed along the first connecting path 21.

Similarly, regarding the travel rail pair 3 installed along the second connecting path 22, its portion in the upstream portion (22*u*) of the second connecting path 22 includes only the right rail member 3R (referred to hereinafter as the second right travel rail 3BR) located on the right hand side of the article transport vehicle 2 traveling along the second connecting path 22 whereas its portion in the downstream portion (22*d*) of the second connecting path 22 includes only the left rail member 3L (referred to hereinafter as the second left travel rail 3BL) located on the left hand side of the article transport vehicle 2 traveling along the second connecting path 22. Note that the second right travel rail 3BR and the second left travel rail 3BL form the second travel rail pair 3B which is the travel rail pair 3 installed along the second connecting path 22.

The third connecting path 23 includes only the right hand side rail member 3*w* (right rail member 3R) of the travel rail pair 3 that is located on the right hand side of the article transport vehicle 2 traveling along the third connecting path 23. The fourth connecting path 24 includes only the left hand side rail member 3*w* (left rail member 3L) of the travel rail pair 3 that is located on the left hand side of the article transport vehicle 2 traveling along the fourth connecting path 23.

The first travel rail pair 3A (the first left travel rail 3AL and first right travel rail 3AR) installed along the first connecting path 21 has, in the crossing portion 30, a first discontinuous section N1 in which the rail members 3*w* are discontinuous. This first discontinuous section N1 is defined to have a length, and is dimensioned, to allow the connecting portion 34 and the guide wheel pairs 38, etc., of the article transport vehicle 2 to travel through it when the article transport vehicle 2 travels along the second connecting path 22. And the first connecting path 21 is formed to have such a length, and is so dimensioned, that travel wheel pairs 37 are located as follows when the article transport vehicle 2 travels along the first connecting path 21 from the first branching portion 26 to the first merging portion 29.

Figure 8:
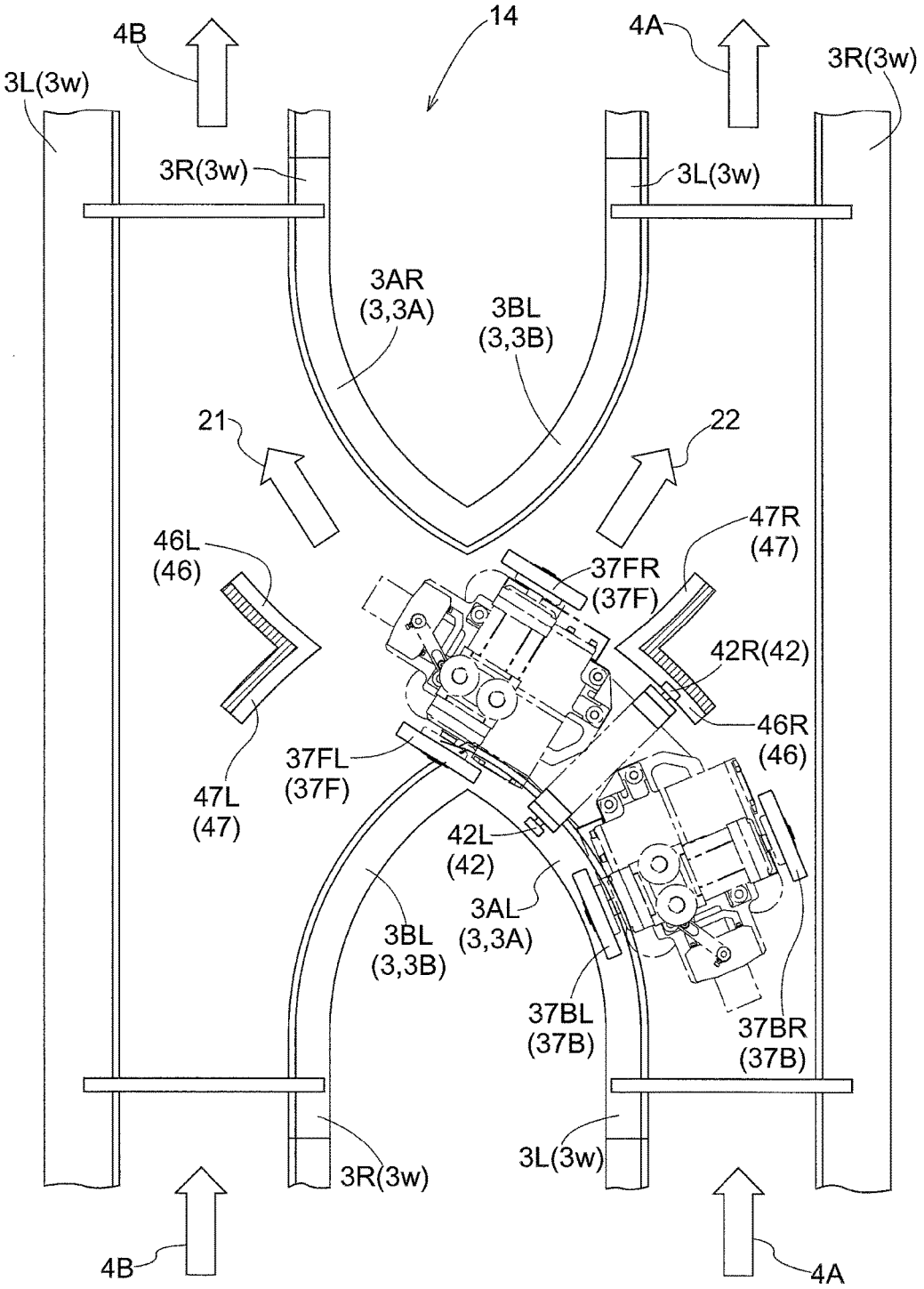
FIG. 8 shows a first traveling state of the article transport vehicle.

Specifically, as shown in FIG. 8, the upstream portion (21*u*) of the first connecting path 21 is formed to have such a length, and is so dimensioned, that, when both travel wheels 37*w* of the front wheel pair 37F are in the first discontinuous section N1, only the right hand side travel wheel 37*w* of the rear wheel pair 37B (i.e., the right rear wheel 37BR, or the rear wheel on the side the first primary path 4A exists along the path width direction X (paths spaced-apart direction) is located between the travel rail pair 3 installed along the first primary path 4A. In addition, as shown in FIG. 8, the downstream portion (21*d*) of the first connecting path 21 is formed to have such a length, and is so dimensioned, that, when both travel wheels 37*w* of the rear wheel pair 37B are in the first discontinuous section N1, only the left hand side travel wheel 37*w* of the front wheel pair 37F (i.e., the left front wheel 37FL, or the front wheel on the side the second primary path 4B exists along the paths spaced-apart direction) is located between the travel rail pair 3 installed along the second primary path 4B.

Similarly, the second travel rail pair 3B (the second right travel rail 3BR and the second left travel rail 3BL) installed along the second connecting path 22 also has, in the crossing portion 30, a second discontinuous section N2 in which the rail members 3*w* are discontinuous. This second discontinuous section N2 is also defined to have a length, or is dimensioned, to allow the connecting portion 34 and the guide wheel pairs 38, etc., of the article transport vehicle 2 to travel through it when the article transport vehicle 2 travels along the first connecting path 21. And the second connecting path 22 is formed to have such a length, and is so dimensioned, that travel wheel pairs 37 are located as follows when the article transport vehicle 2 travels along the second connecting path 22 from the second branching portion 28 to the second merging portion 27.

Figure 10:
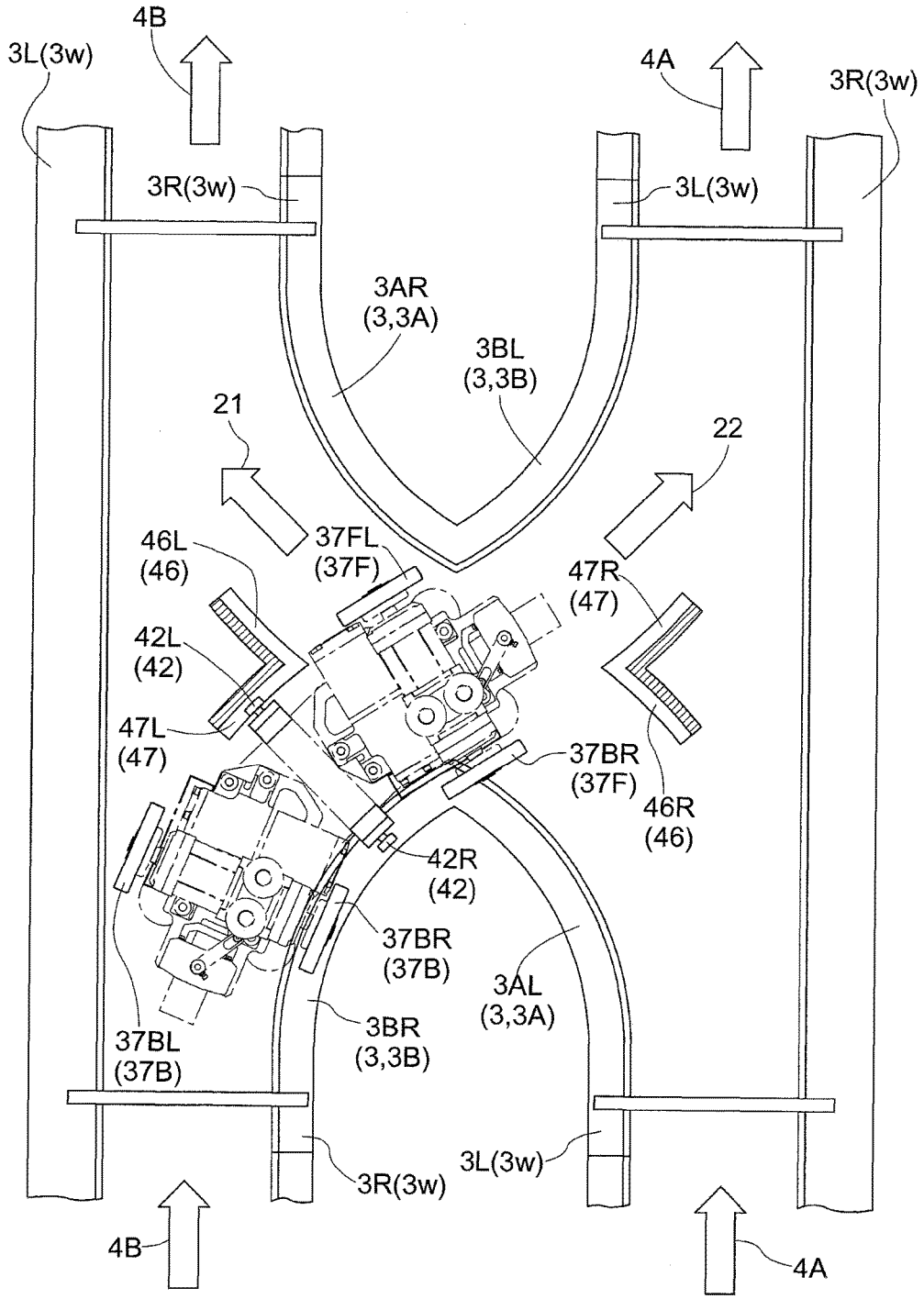
FIG. 10 shows a third traveling state of the article transport vehicle.
Figure 11:
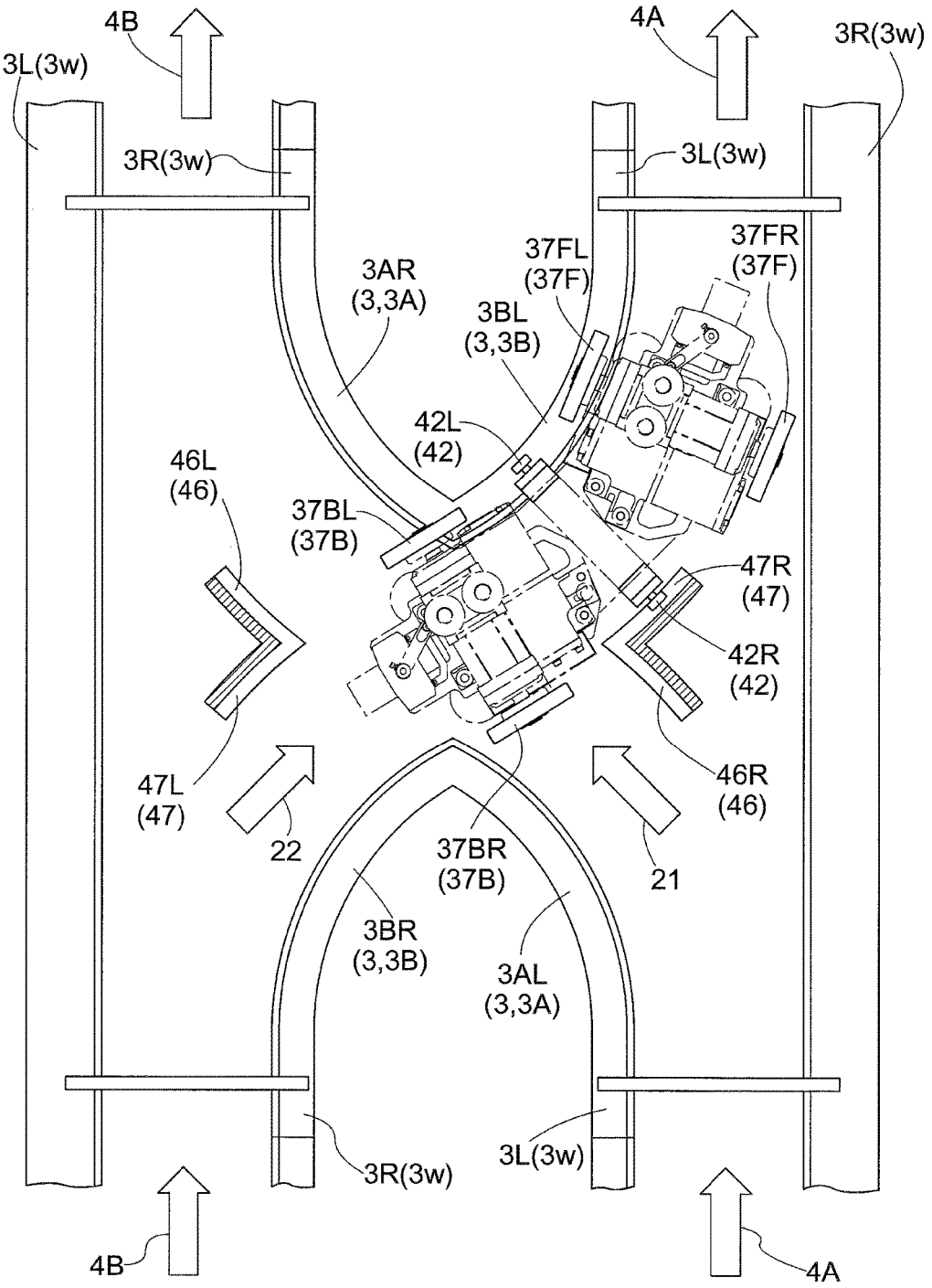
FIG. 11 shows a fourth traveling state of the article transport vehicle.

Specifically, as shown in FIG. 10, the upstream portion (22*u*) of the second connecting path 22 is formed to have such a length, and is so dimensioned, that, when both travel wheels 37*w* of the front wheel pair 37F are in the second discontinuous section N2, only the left hand side travel wheel 37*w* of the rear wheel pair 37B (i.e., the left rear wheel 37BL, or the rear wheel on the side the second primary path 4B exists along the paths spaced-apart direction) is located between the travel rail pair 3 installed along the second primary path 4B. In addition, as shown in FIG. 11, the downstream portion of the second connecting path 22 is formed to have such a length, and is so dimensioned, that, when both travel wheels 37*w* of the rear wheel pair 37B are in the second discontinuous section N2, only the right hand side travel wheel 37*w* of the front wheel pair 37F (i.e., the right front wheel 37FR, or the front wheel on the side the first primary path 4A exists along the paths spaced-apart direction) is located between the travel rail pair 3 installed along the first primary path 4A.

Here, first traveling state, second traveling state, third traveling state, and fourth traveling state are defined as follows. The first traveling state is a state in which both of the travel wheels 37*w* of the front wheel pair 37F are in the first discontinuous section N1 when the article transport vehicle 2 travels through the crossing portion 30 along the first connecting path 21. The second traveling state is a state in which both of the travel wheels 37*w* of the rear wheel pair 37B are in the first discontinuous section N1 when the article transport vehicle 2 travels through the crossing portion 30 along the first connecting path 21. The third traveling state is a state in which both of the travel wheels 37*w* of the front wheel pair 37F are in the second discontinuous section N2 when the article transport vehicle 2 travels through the crossing portion 30 along the second connecting path 22. And the fourth traveling state is a state in which both of the travel wheels 37*w* of the rear wheel pair 37B are in the second discontinuous section N2 when the article transport vehicle 2 travels through the crossing portion 30 along the second connecting path 22. Note that the state in which both travel wheels 37*w* of the travel wheel pair 37 (37F, or 37B) are in a discontinuous section N (N1, or N2) means a state in which the pivot axis, or axes, of the travel wheel pair 37 (37F, 37B) is, or are, located in the discontinuous section N (N1, N2) in plan view.

As described above, the first auxiliary rail pair 46 (pair of right and left first guide members) and the second auxiliary rail pair 47 (pair of right and left second guide members) are provided in the path changing portion 14. The first auxiliary rail pair 46 includes the first right auxiliary rail 46R and the first left auxiliary rail 46L. The first right auxiliary rail 46R is provided to extend along the first connecting path 21 at a location in the first connecting path 21 and on the upstream side (upstream portion (21*u*)) of the location of the first discontinuous section N1. The first left auxiliary rail 46L is provided to extend along the first connecting path 21 at a location in the first connecting path 21 and on the downstream side (downstream portion (21*d*)) of the location of the first discontinuous section N1. In addition, the second auxiliary rail pair 47 includes the second left auxiliary rail 47L and the second right auxiliary rail 47R. The second left auxiliary rail 47L is provided to extend along the second connecting path 22 at a location in the second connecting path 22 and on the upstream side (upstream portion (22*u*)) of the location of the second discontinuous section N2. The second right auxiliary rail 47R is provided to extend along the second connecting path 22 at a location in the second connecting path 22 and on the downstream side (downstream portion (22*d*)) of the location of the second discontinuous section N2.

The first right auxiliary rail 46R supports the right travel auxiliary wheel 42R of the travel auxiliary wheel pair 42*p* from below (see FIG. 8) in the first traveling state, when the article transport vehicle 2 travels through the crossing portion 30 along the first connecting path 21. The first left auxiliary rail 46L supports the left travel auxiliary wheel 42L of the travel auxiliary wheel pair 42*p* from below (see FIG. 9) in the second traveling state, when the article transport vehicle 2 travels through the crossing portion 30 along the first connecting path 21. In other words, the first auxiliary rail pair 46 is provided to support, in the first traveling state, only the right travel auxiliary wheel 42R (i.e., travel auxiliary wheel 42 on the side in which the first primary path 4A exists) of the travel auxiliary wheel pairs 42*p*, and to support, in the second traveling state, only the left travel auxiliary wheel 42L (i.e., travel auxiliary wheel 42 on the side in which the second primary path 4B exists) of the travel auxiliary wheel pairs 42*p*, when the article transport vehicle 2 travels along the first connecting path 21 from the first branching portion 26 to the first merging portion 29.

In addition, as to its action on the travel auxiliary wheels 42, the first auxiliary rail pair 46 is configured to allow the travel auxiliary wheel pair 42*p* to move (i.e., to rotate) in the travel direction and to restrict, or prevent, downward movement of the travel auxiliary wheel 42 that is being guided thereby, in the first traveling state and in the second traveling state, when the article transport vehicle 2 travels through the crossing portion 30 along the first connecting path 21. Note that in the first traveling state and the second traveling state, one auxiliary wheel of the travel auxiliary wheel pair 42*p* is pushed against the travel surface (46*f*) of the first auxiliary rail pair 46 from above. Therefore, in the first traveling state and the second traveling state, the one of the travel auxiliary wheels 42 can move in travel direction by rolling on a travel surface (46*f*) of the first auxiliary rail pair 46 but cannot move vertically because such vertical movement is restricted or prevented by the travel surface (46*f*).

Similarly, the second left auxiliary rail 47L supports the left travel auxiliary wheel 42L of the travel auxiliary wheel pair 42*p* from below (see FIG. 10) in the third traveling state, when the article transport vehicle 2 travels through the crossing portion 30 along second connecting path 22. The second right hand side auxiliary rail 47R supports the right travel auxiliary wheel 42R of the travel auxiliary wheel pair 42*p* from below (see FIG. 11) in the fourth traveling state, when the article transport vehicle 2 travels through the crossing portion 30 along the second connecting path 22. In other words, the second auxiliary rail pair 47 is provided to support, in the third traveling state, only the left travel auxiliary wheel 42L (i.e., travel auxiliary wheel 42 on the side in which the second primary path 4B exists) of the travel auxiliary wheel pairs 42*p*, and to support, in the fourth traveling state, only the right travel auxiliary wheel 42R (i.e., travel auxiliary wheel 42 on the side in which the first primary path 4A exists) of the travel auxiliary wheel pairs 42*p*, when the article transport vehicle 2 travels along the second connecting path 22 from the second branching portion 28 to the second merging portion 27.

In addition, as to its action on the travel auxiliary wheels 42, similarly to the first auxiliary rail pair 46, the second auxiliary rail pair 47 is also configured to allow the travel auxiliary wheel pair 42*p* to move (i.e., to rotate) in the travel direction and to restrict, or prevent, downward movement of the travel auxiliary wheel 42 that is being guided thereby, in the third traveling state and in the fourth traveling state, when the article transport vehicle 2 travels through the crossing portion 30 along the second connecting path 22. Similarly to the case of the first traveling state and the second traveling state, in the third traveling state and the fourth traveling state, one auxiliary wheel of the travel auxiliary wheel pair 42*p* is pushed against the travel surface (47*f*) of the second auxiliary rail pair 47 from above. Therefore, in the third traveling state and the fourth traveling state, the one auxiliary wheel of the travel auxiliary wheel pair 42 can move in travel direction by rolling on a travel surface (47*f*) of the second auxiliary rail pair 47 but cannot move vertically because such vertical movement is restricted or prevented by the travel surface (47*f*).

Figure 12:
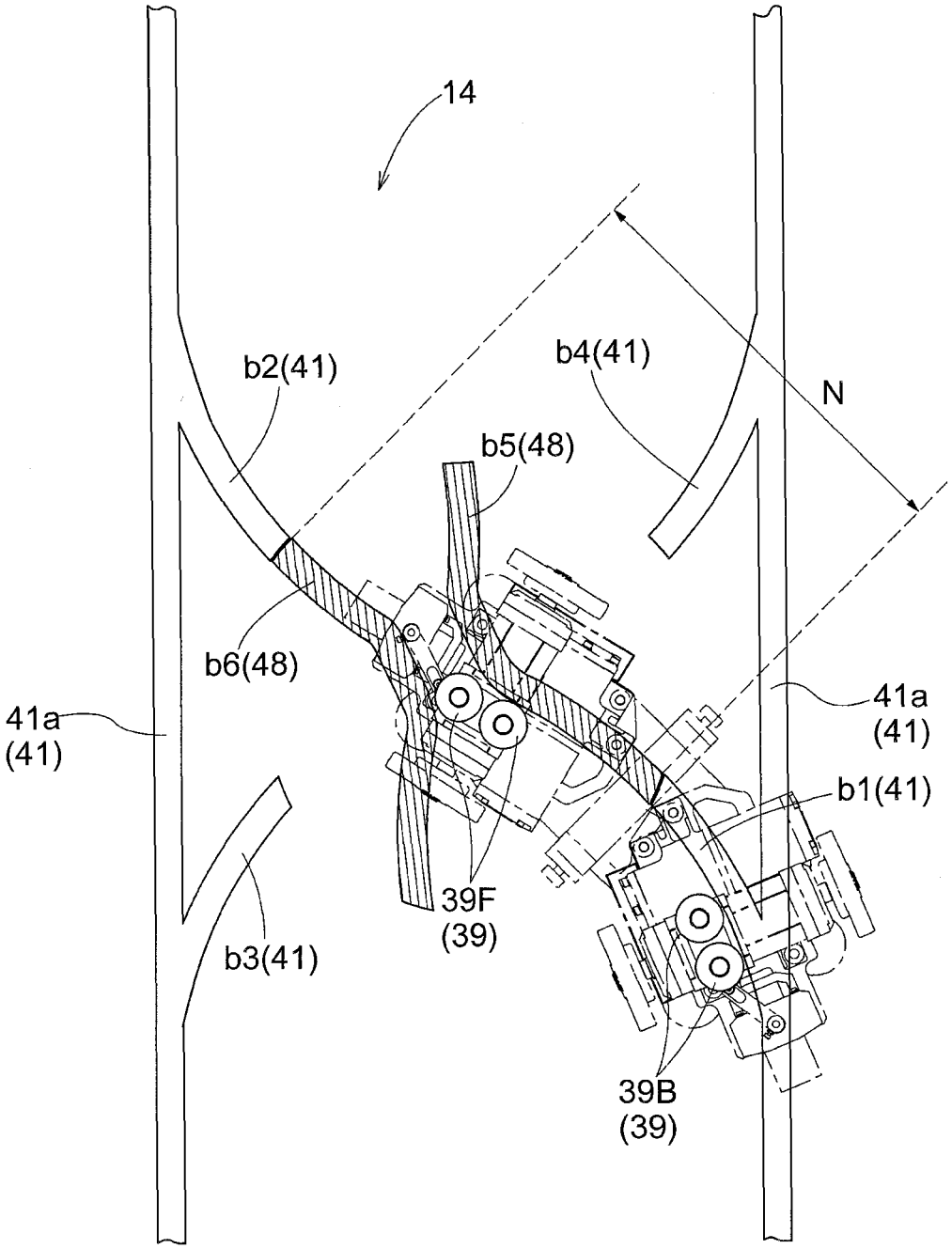
FIG. 12 is a plan view of the crossing portion when a pair of movable guide rails are in a first guiding position.
Figure 13:
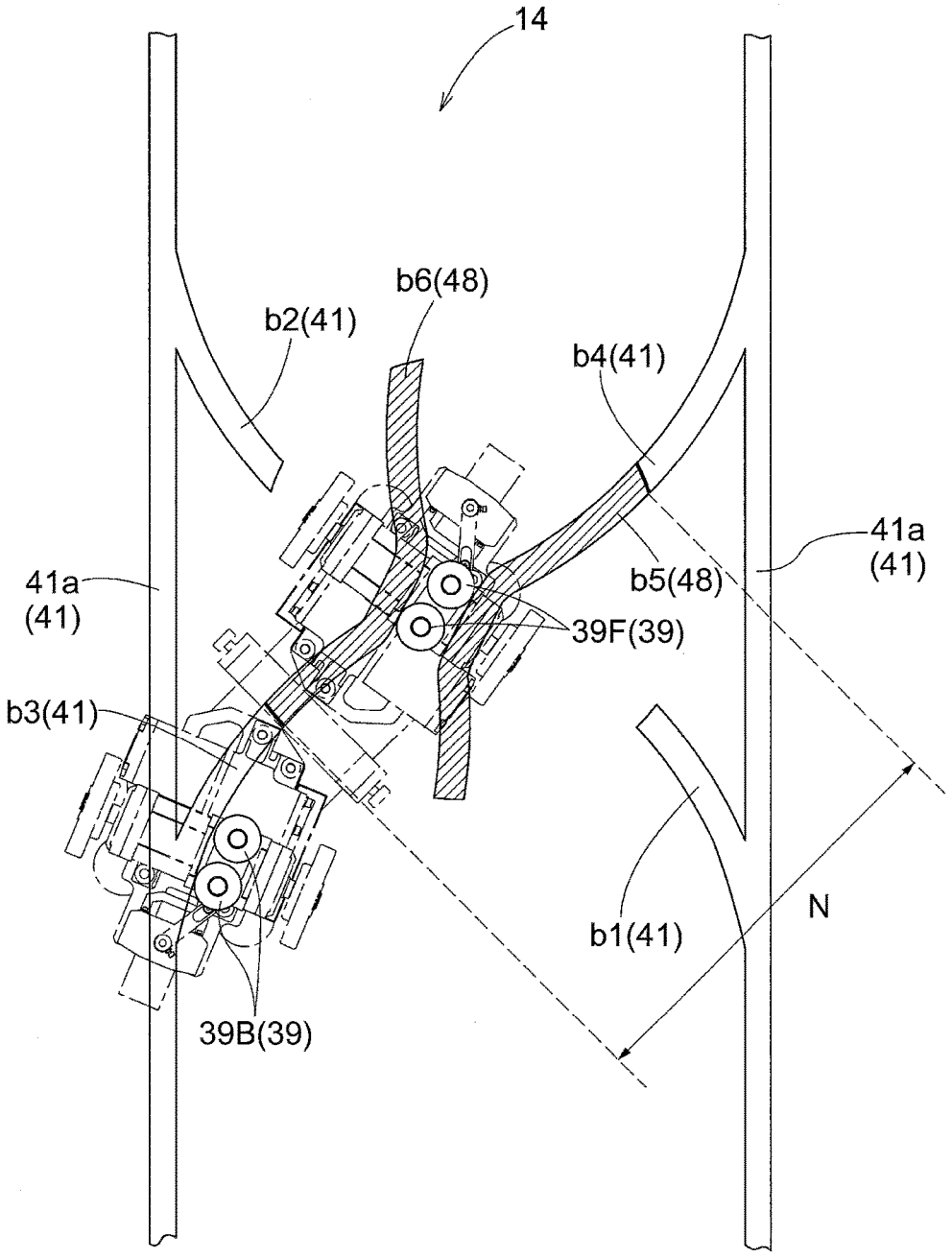
FIG. 13 is a plan view of the crossing portion when the pair of movable guide rails are in a second guiding position.

As shown in FIGS. 12 and 13, four guide rails, namely, a first upstream guide rail b1, a first downstream guide rail b2, a second upstream guide rail b3, and a second downstream guide rail b4, are provided in the path changing portion 14 as fixed guide rails 41 (fixed auxiliary rails). The first upstream guide rail b1 is a guide rail 41 provided to extend along the upstream portion (21*u*) of the first connecting path 21. The first downstream guide rail b2 is a guide rail 41 provided to extend along the downstream portion (21*d*) of the first connecting path 21. The second upstream guide rail b3 is a guide rail 41 provided to extend along the upstream portion (22*u*) of the second connecting path 22. And the second downstream guide rail b4 is a guide rail 41 provided to extend along the downstream portion (22*d*) of the second connecting path 22.

Provided between the first upstream guide rail b1 and the first downstream guide rail b2 is a discontinuous section N in which the guide rail 41 forms a gap and is discontinuous (see FIG. 12) to allow the guide auxiliary wheel pair 39 of the article transport vehicle 2 to travel through it when the article transport vehicle 2 travels along the second connecting path 22. In addition, provided between the second upstream guide rail b3 and the second downstream guide rail b4 is a discontinuous section N in which the guide rail 41 forms a gap and is discontinuous (see FIG. 13) to allow the guide auxiliary wheel pair 39 of the article transport vehicle 2 to travel through it when the article transport vehicle 2 travels along the first connecting path 21. Note that these guide rails (b1, b2, b3, b4) may be called fixed auxiliary rails provided at locations that are along the first connecting path 21 and the second connecting path 22 and that are other than the location at which the movable guide rail pair 48 (movable auxiliary rails) described below is installed, in order to guide the guide auxiliary wheel pair 39 (branching guided members) along the first connecting path 21 and the second connecting path 22.

As shown in FIGS. 12 and 13, in addition to the four fixed auxiliary rails (b1, b2, b3, b4) described above, a pair of right and left movable guide rail pair 48 which includes a first movable guide rail b5 and a second movable guide rail b6 is provided in the path changing portion 14. The movable guide rail pair 48 is configured to be switched between a first guiding attitude (first attitude) shown in FIG. 12 and a second guiding attitude (second attitude) shown in FIG. 13. The first guiding attitude is an attitude in which each of the first movable guide rail b5 and the second movable guide rail b6 are generally along the first connecting path 21. More specifically, the first movable guide rail b5 is connected to, or is in series with, the first upstream guide rail b1 while the second movable guide rail b6 is connected to, or is in series with, the first downstream guide rail b2. The second guiding attitude is an attitude in which each of the first movable guide rail b5 and the second movable guide rail b6 are generally along the second connecting path 22. More specifically, the second movable guide rail b6 is connected to, or is in series with, the second upstream guide rail b3 while the first movable guide rail b5 is connected to, or in series with, the second downstream guide rail b4. In other words, the first guiding attitude is an attitude (first attitude) for guiding the guide auxiliary wheel pairs 39 along the first connecting path 21 while restricting or preventing movement of the guide auxiliary wheel pairs 39 along the path width direction X of the first connecting path 21. In addition, the second guiding attitude is an attitude (second attitude) for guiding the guide auxiliary wheel pairs 39 along the second connecting path 22 while restricting or preventing movement of the guide auxiliary wheel pairs 39 along the path width direction X of the second connecting path 22.

As shown in FIGS. 8 and 12, when the article transport vehicle 2 traveling along the first primary path 4A enters the path changing portion 14 with the guide auxiliary wheel pairs 39 moved to the left guiding position, the article transport vehicle 2 is caused to travel with the guide auxiliary wheel pairs 39 located on the left hand side of the first upstream guide rail b1. Thus, the guide auxiliary wheel pairs 39 are guided by the first upstream guide rail b1 to carry out a branching travel from the first primary path 4A to the first connecting path 21 (i.e., to travel along the first connecting path 21 that branches off from the first upstream path 15 shown in FIG. 7).

When the article transport vehicle 2 carries out a branching travel from the first primary path 4A (first upstream path 15) to the first connecting path 21, the travel auxiliary wheel pair 42*p* is lowered to the lower position. The article transport vehicle 2 raises the right travel auxiliary wheel 42R to its upper position after the right travel auxiliary wheel 42R of the travel auxiliary wheel pair 42*p* moves past the guide rail 41 (primary path guide rail 41*a*) provided along the first primary path 4A, that is, after it reaches the downstream side in the first connecting path 21 with respect to the primary path guide rail 41*a*, and before the right travel auxiliary wheel 42R reaches the first right auxiliary rail 46R.

The article transport vehicle 2 comes to be in the first traveling state described above, when the article transport vehicle 2 travels along the first connecting path 21 after the right travel auxiliary wheel 42R is raised to the upper position. In this first traveling state, both travel wheels 37*w* of the front wheel pair 37F and the right hand side travel wheel 37*w* (right rear wheel 37BR) of the rear wheel pair 37B are unsupported by any rail member 3*w*. However, tilting of the article transport vehicle 2 toward the front or to the right is restricted, or prevented, by virtue of the fact that the right travel auxiliary wheel 42R is supported by the first right auxiliary rail 46R as shown in FIG. 8 and of the fact that the guide auxiliary wheel pair 39 contacts the first upstream guide rail b1 from the left hand side as shown in FIG. 12.

As the article transport vehicle 2 travels further from the position where it is in the first traveling state, it moves into the second traveling state. As this takes place, the article transport vehicle 2 lowers the right travel auxiliary wheel 42R and raises the left travel auxiliary wheel 42L after leaving the first traveling state and before it is in the second traveling state. That is, after the right travel auxiliary wheel 42R reaches a position on the downstream side with respect to the first right auxiliary rail 46R and before the left travel auxiliary wheel 42L reaches the first left auxiliary rail 46L, the article transport vehicle 2 lowers the right travel auxiliary wheel 42R to its lower position and raises the left travel auxiliary wheel 42L to its upper position. Note that the article transport vehicle 2 lowers the left travel auxiliary wheel 42L to its lower position after the left travel auxiliary wheel 42L reaches a position on the downstream side with respect to the first left auxiliary rail 46L and before the left travel auxiliary wheel 42L reaches the guide rail 41 (primary path guide rail 41*a*) provided along the second primary path 4B.

In addition, when the article transport vehicle 2 travels from a position where it is in the first traveling state to a position where it is in the second traveling state, the guide auxiliary wheel pair 39 in the left guiding position are guided initially by the first movable guide rail b5 of the movable guide rail pair 48 in the first guiding position. As the article transport vehicle 2 advances, the second movable guide rail b6 comes into contact with the left hand side of the guide auxiliary wheel pair 39. As described above, although movement of the guide auxiliary wheel pairs 39 in the left guiding position to the left XL is restricted or prevented, they are not restricted or prevented from moving to the right XR; thus, they can move to the right guiding position. Similarly, although movement of the guide auxiliary wheel pairs 39 in the right guiding position to the right XR is restricted or prevented, they are not restricted or prevented from moving to the left XL; thus, they can move to the left guiding position. After the second movable guide rail b6 comes into contact with the left hand side of the guide auxiliary wheel pair 39, the pressing force from the first movable guide rail b5 in contact with the right hand side of the guide auxiliary wheel pair 39 decreases; thus, The guide auxiliary wheel pair 39 is moved to its right guiding position as it is guided from the left hand side to the right hand side by the second movable guide rail b6.

Figure 9:
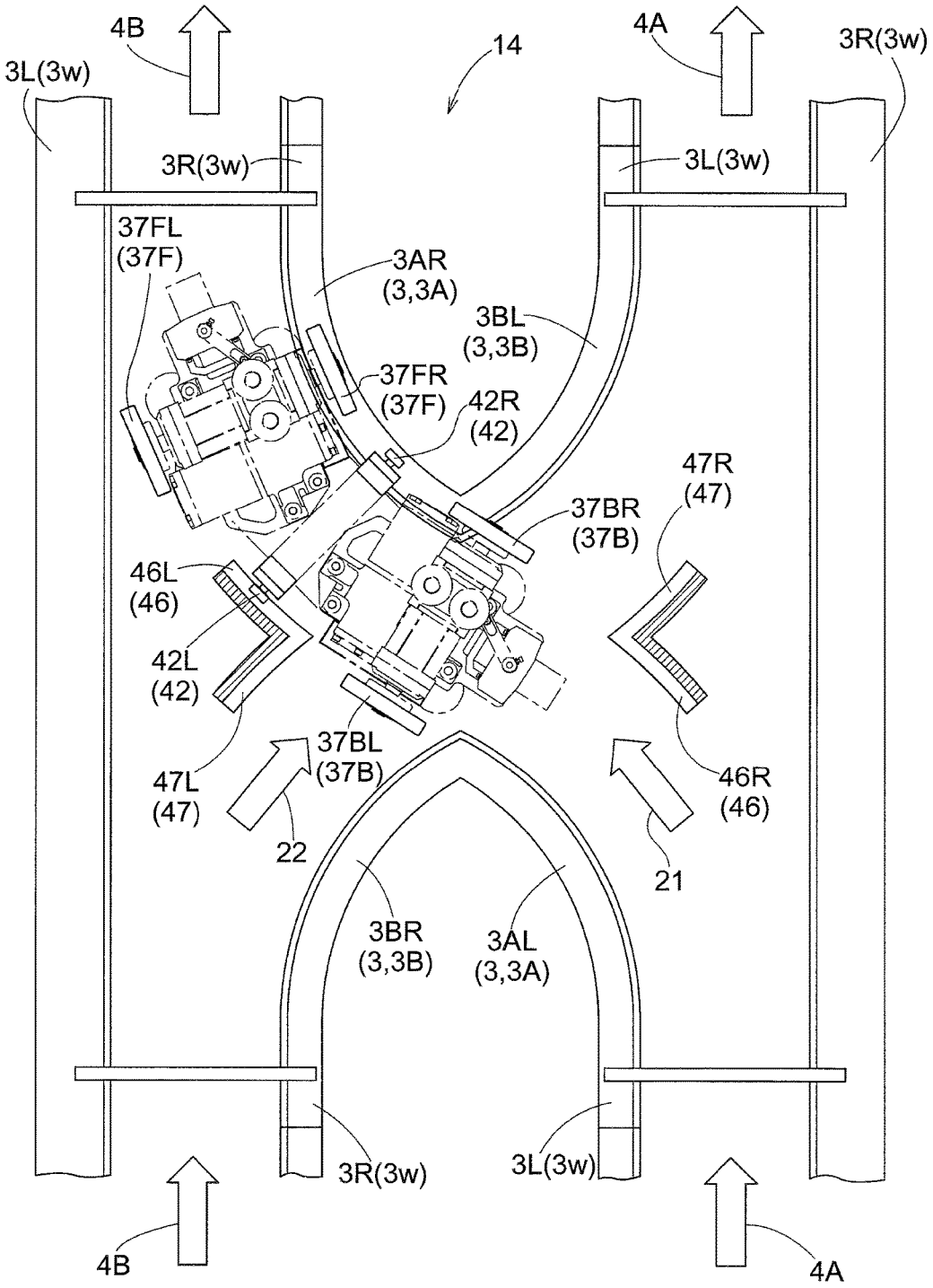
FIG. 9 shows a second traveling state of the article transport vehicle.

In the second traveling state, the left hand side travel wheel 37*w* (left front wheel 37FL) of the front wheel pair 37F and both travel wheels 37*w* of the rear wheel pair 37B are unsupported by any rail member 3*w*. However, tilting of the article transport vehicle 2 toward the back or to the left is restricted, or prevented by virtue of the fact that the left travel auxiliary wheel 42L is supported by the first left auxiliary rail 46L as shown in FIG. 9 and of the fact that the guide auxiliary wheel pair 39 contacts the right hand side of the first downstream guide rail b1 (not shown but similar to what is shown in FIG. 12).

Similarly, when the article transport vehicle 2 traveling along the second primary path 4B enters the path changing portion 14 with the guide auxiliary wheel pairs 39 moved to the right guiding position, the article transport vehicle 2 is caused to travel with the guide auxiliary wheel pairs 39 located on the right hand side of the second upstream guide rail b3. Thus, the guide auxiliary wheel pairs 39 are guided by the second upstream guide rail b3 to cause the article transport vehicle 2 to carry out a branching travel from the second primary path 4B to the second connecting path 22 (i.e., the article transport vehicle 2 travels along the second connecting path 22 that branches off from the second upstream path 16 shown in FIG. 7).

The article transport vehicle 2 comes to be in the third traveling state and the fourth traveling state while it travels along the second connecting path 22. Note that the timing of raising and lowering the travel auxiliary wheel pair 42*p* and the movements of the guide auxiliary wheel pairs 39, etc., when the article transport vehicle 2 travels along the second connecting path 22, are similar to those for when the article transport vehicle 2 travels along the first connecting path 21; thus, detailed descriptions therefor are omitted.

In the third traveling state, both travel wheels 37*w* of the front wheel pair 37F and the left hand side travel wheel 37*w* (left rear wheel 37BL) of the rear wheel pair 37B are unsupported by any rail member 3*w*. However, tilting of the article transport vehicle 2 toward the front or to the left is restricted, or prevented by virtue of the fact that the left travel auxiliary wheel 42L is supported by the second left auxiliary rail 47L and of the fact that the guide auxiliary wheel pair 39 contacts the right hand side of the second upstream guide rail b3. In addition, in the fourth traveling state, the right hand side travel wheel 37*w* (right front wheel 37FR) of the front wheel pair 37F and both travel wheels 37*w* of the rear wheel pair 37B are unsupported by any rail member 3*w*. However, tilting of the article transport vehicle 2 toward the back or to the right is restricted, or prevented by virtue of the fact that the right travel auxiliary wheel 42R is supported by the second right auxiliary rail 47R and of the fact that the guide auxiliary wheel pair 39 contact the left hand side of the second downstream guide rail b4.

When the article transport vehicle 2 travels a portion of the path that is curved to the left (the upstream portion (21*u*) of the first connecting path 21, and the downstream portion (22*d*) of the second connecting path 22), the article transport vehicle 2 is bent to the left XL as shown in FIGS. 8 and 11. In other words, the front travel portion 32F pivots or turns counterclockwise. This causes the power receiving portion 52 to slide to the right along the vehicle body lateral direction XX and thus, also causing the travel auxiliary wheel pair 42*p* supported by the power receiving portion 52 to be moved to the right along the vehicle body lateral direction XX. When the article transport vehicle 2 travels a portion of the path that is curved to the right (the downstream portion (21*d*) of the first connecting path 21, and the upstream portion (22*u*) of the second connecting path 22), the article transport vehicle 2 is bent to the right XR as shown in FIGS. 9 and 10. In other words, the front travel portion 32F pivots or turns clockwise. This causes the power receiving portion 52 to slide to the left along the vehicle body lateral direction XX and thus, also causing the travel auxiliary wheel pair 42*p* supported by the power receiving portion 52 to be moved to the left along the vehicle body lateral direction XX.

Thus, when the article transport vehicle 2 travels along the first connecting path 21, and when the article transport vehicle 2 is in the first traveling state and the second traveling state, tilting of the article transport vehicle 2 can be restricted or prevented by supporting the travel auxiliary wheel pair 42*p* from below with the first auxiliary rail pair 46. In addition, when the article transport vehicle 2 travels along the second connecting path 22, and when the article transport vehicle 2 is in the third traveling state and the fourth traveling state, tilting of the article transport vehicle 2 can be restricted or prevented by supporting the travel auxiliary wheel pair 42*p* from below with the second auxiliary rail pair 47.

Alternative Embodiments (1) In the descriptions above, an exemplary embodiment is described in which the guided members are a pair of right and left auxiliary wheel (travel auxiliary wheel pair 42*p*) which can be rotated about an axis extending along the vehicle body lateral direction XX. However, the guided members may be a pair of right and left slide members that are in sliding contact with the first guide member exemplified by the first auxiliary rail pair 46 and the second guide member exemplified by the second auxiliary rail pair 47 respectively.

(2) In the descriptions above, an exemplary embodiment is described in which the guided members (travel auxiliary wheel pair 42*p*) are located at a middle position between the front wheel pair 37F and the rear wheel pair 37B (middle position between the first travel wheel pair and the second travel wheel pair) along the vehicle body fore and aft direction YY. However, the positions of the guided members and the number of locations of the guided members may be changed suitably.

For example, the guided members may include a first guided member located at a position forward of a middle position between the front wheel pair 37F and the rear wheel pair 37B along the vehicle body fore and aft direction YY and a second guided member located at a position rearward of the middle position. In this case, forward tilting of the article transport vehicle 2 may be restricted or prevented by supporting the first guided member from below with the first guide member or the second guide member whereas backward tilting of the article transport vehicle 2 may be restricted or prevented by supporting the second guided member from below with the first guide member or the second guide member.

In addition, the guided members may include a first guided member located rearward of the rear wheel pair 37B along the vehicle body fore and aft direction YY and a second guided member located forwardly of the front wheel pair 37F. In this case, forward tilting of the article transport vehicle 2 may be restricted or prevented by causing the first guide member or the second guide member to contact the first guided member from above whereas backward tilting of the article transport vehicle 2 may be restricted or prevented by causing the first guide member or the second guide member to contact the second guided member from above.

(3) In the descriptions above, an exemplary embodiment is described in which, in the four traveling states, i.e., the first to fourth traveling states, only one auxiliary wheel (travel auxiliary wheel 42) of the pair of right and left auxiliary wheels (travel auxiliary wheel pair 42*p*) is supported by the first guide members (first auxiliary rail pair 46) or the second guide members (second auxiliary rail pair 47). However, in one or more, or all four traveling states, both wheels of the pair of right and left auxiliary wheel (travel auxiliary wheel pair 42*p*) may be supported by the first guide members (first auxiliary rail pair 46) or the second guide members (second auxiliary rail pair 47).

(4) In addition, each first guide member (first auxiliary rail pair 46) may be formed in a shape of C with sharp corners (or in a bracket shape), as seen along the vehicle body fore and aft direction YY. Downward movement of each guided member (travel auxiliary wheel 42) would be restricted or prevented by virtue of the fact that the guided member comes into contact with a lower portion of the first guide member of the C-shape. Also, upward movement of each guided member (travel auxiliary wheel 42) would be restricted or prevented by virtue of the fact that the guided member comes into contact with an upper portion of the first guide member of the C-shape. That is, arrangements may be made such that the first guide member (first auxiliary rail pair 46) of the C-shape actively restricts or prevents vertical movement of each guided member (travel auxiliary wheel 42). Similarly, each second guide member (second auxiliary rail pair 47) may be formed in a shape of C with sharp corners (or in a bracket shape) and may actively restrict or prevent vertical movement of each guided member (travel auxiliary wheel 42).

(5) In the descriptions above, an exemplary embodiment is described in which the first path (first connecting path 21) has such a length, or so dimensioned, that, when the article transport vehicle 2 is in the first traveling state, its right rear wheel 37BR of the article transport vehicle 2 in the first traveling state is located between the travel rail pair 3 installed along the first primary path 4A, and that when the article transport vehicle 2 is in the second traveling state, its left rear wheel 37FL of the article transport vehicle 2 in the second traveling state is located between the travel rail pair 3 installed along the second primary path 4B. However, the length of the first path (first connecting path 21) may be changed suitably. For example, the first path may have such a length, or may be so dimensioned, that, when the article transport vehicle 2 is the first traveling state, the right rear wheel 37BR of the article transport vehicle 2 in the first traveling state is located on the side in which the crossing portion 30 exists along the path width direction X (paths spaced-apart direction) with respect to the travel rail pair 3 installed along the first primary path 4A. Similarly, the length of the second path (second connecting path 22) may also be changed suitably.

(6) In the descriptions above, an exemplary embodiment is described in which, in the four traveling states, i.e., the first to fourth traveling states, only one of the four travel wheels (37FL, 37FR, 37BL, 37BR) of the article transport vehicle 2 is supported by a rail member 3*w*. However, the travel rail pairs 3 may be installed such that, in one or more, or in all of the four traveling states, and among the two sets of travel wheel pair 37 (four wheels) of the article transport vehicle 2, both of the travel wheels 37*w* of the travel wheel pair 37 that is not located in the discontinuous section N are supported.

(7) In the descriptions above, an exemplary embodiment is described in which the first guide members (first auxiliary rail pair 46) and the second guide members (second auxiliary rail pair 47) are provided separately from and in addition to the travel rail pairs 3 (rail member 3*w*). However, arrangements may be made such that the guided members can contact the rail members 3*w* such that the rail members 3*w* can function as the first guide members (first auxiliary rail pair 46) and the second guide members (the second auxiliary rail pair 47).

(8) In the descriptions above, an exemplary embodiment is described in which the raising and lowering actuators (travel auxiliary actuators 43) are provided for raising and lowering the guided members (travel auxiliary wheels 42) to the upper position and to the lower position. However, the raising and lowering actuators (travel auxiliary actuator 43) do not need to be provided, when there is no possibility of the guided member (travel auxiliary wheel 42) interfering, or coming into contact, with the surrounding objects such as the guide rail 41, etc., even if the article transport vehicle 2 travels with the guided member (travel auxiliary wheel 42) in the upper position, for example, by positioning the first guide members (first auxiliary rail pair 46) and the second guide members (second auxiliary rail pair 47) below the guide rail 41.

Brief Summary of Embodiments

The article transport facility described above is briefly summarized next.

In one embodiment, an article transport facility comprises: an article transport vehicle configured to travel along travel paths to transport an article; a travel rail pair on which the article transport vehicle travels, the travel rail pair including two rail members arranged in parallel and spaced apart from each other at a constant distance along a width direction which is perpendicular to a direction along which a corresponding travel path extends; first guide members whose positions are fixed with respect to the travel rail pair; second guide members whose positions are fixed with respect to the travel rail pair; wherein the article transport vehicle includes a first travel wheel pair including a pair of right and left travel wheels which roll on travel surfaces of the travel rail pair, a second travel wheel pair located on one side with respect to the first travel wheel pair along a vehicle body fore and aft direction which is along a travel direction of the article transport vehicle, the second travel wheel pair including a pair of right and left travel wheels which roll on the travel surfaces of the travel rail pair, guided members whose vertical positions can be fixed with respect to the first travel wheel pair and the second travel wheel pair, wherein the travel paths include a first path, a second path that crosses the first path, and a crossing portion in which the first path and the second path cross each other, wherein a first travel rail pair which is the travel rail pair provided along the first path has, in the crossing portion, a first discontinuous section in which the rail members are discontinuous, wherein a second travel rail pair which is the travel rail pair provided along the second path has, in the crossing portion, a second discontinuous section in which the rail members are discontinuous, wherein the first guide members allow movement of the guided members in the travel direction and restrict vertical movement of one or more of the guided members, in a first traveling state in which the first travel wheel pair is in the first discontinuous section and in a second traveling state in which the second travel wheel pair is in the first discontinuous section, when the article transport vehicle travels through the crossing portion along the first path, and wherein the second guide members allow movement of the guided members in the travel direction and restrict vertical movement of one or more of the guided members, in a third traveling state in which the first travel wheel pair is in the second discontinuous section and in a fourth traveling state in which the second travel wheel pair is in the second discontinuous section, when the article transport vehicle travels through the crossing portion along the second path.

With this arrangement, by providing the first discontinuous section and the second discontinuous section, the article transport vehicle can travel through the crossing portion without the mounted members mounted on the article transport vehicle contacting the travel rails of the paths that cross each other. Even if the article transport vehicle includes, for example, mounted members that are located between the right and left rail members, the article transport vehicle travels through the second discontinuous section in the second travel rails when it travels through the crossing portion along the first path, and the article transport vehicle travels through the first discontinuous section in the first travel rails when it travels through the crossing portion along the first path.

When the article transport vehicle is in the first traveling state and in the second traveling state, the first guide members allow movement of the guided members in the travel direction and restrict vertical movement of one or more of the guided members. Therefore, forward or backward tilting of article transport vehicle can be restricted when the article transport vehicle travels through the crossing portion along the first path. When the article transport vehicle is in the third traveling state and in the fourth traveling state, the second guide members allow movement of the guided members in the travel direction and restrict vertical movement of one or more of the guided members. Therefore, forward or backward tilting of article transport vehicle can be restricted when the article transport vehicle travels through the crossing portion along the second path.

In addition, the first guide members and the second guide member are provided such that their positions with respect to the travel rail pair are fixed. Therefore, for example, the first guide members and the second guide members do not have to be movable, and neither is it necessary to provide an actuator device for moving these guide members. Thus, with the arrangements described above, the crossing portion has a simple structure, and forward or backward tilting, or leaning, of the article transport vehicle when travelling through the crossing portion is reduced.

Here, the guided members are preferably a pair of right and left auxiliary wheels which rotate about one or more axes extending along a vehicle body lateral direction of the article transport vehicle, wherein the pair of auxiliary wheels are preferably located at a middle position between the first travel wheel pair and the second travel wheel pair along the vehicle body fore and aft direction.

With the arrangement described above, because the guided members are rotating auxiliary wheel pair, smooth guiding action is realized by virtue of the fact that the auxiliary wheel pair roll in the travel direction along the first guide members and the second guide members. In addition, since the pair of auxiliary wheels are located at a middle position between the first travel wheel pair and the second travel wheel pair along the vehicle body fore and aft direction, when the article transport vehicle tilts or leans forward or backward in any of the first to the fourth traveling states, the auxiliary wheel pair would also move downward. And since the auxiliary wheels are located at a middle position, approximately the same amount of downward force would be applied to the pair of auxiliary wheels regardless of whether the article transport vehicle tilts forward or backward. Thus, without having to be concerned specifically about the load or force on the auxiliary wheel guided by the first guide member in the first traveling state and in the second traveling state, and the load or force on the auxiliary wheel guided by the first guide member in the third traveling state and in the fourth traveling state, the same pair of auxiliary wheels may be used for all of these traveling states. Thus, the structure of the article transport vehicle can be simplified.

In addition, in one embodiment of the article transport facility, in addition to the first path and the second path, the travel paths preferably include a first primary path, and a second primary path which extends along the first primary path, wherein the crossing portion is preferably located between the first primary path and the second primary path along a paths spaced-apart direction in plan view, with the paths spaced-apart direction being defined to be a direction along which the first primary path and the second primary path are spaced apart from each other in plan view, wherein the first path is preferably connected to a first connecting portion of the first primary path and to a second connecting portion of the second primary path, wherein the second path is preferably connected to a third connecting portion of the second primary path and to a fourth connecting portion of the first primary path, wherein the first path is preferably formed to have such a length that, when the article transport vehicle travels along the first path from the first connecting portion to the second connecting portion; and when one of the first travel wheel pair and the second travel wheel pair that is located forward of the other of the first travel wheel pair and the second travel wheel pair along the vehicle body fore and aft direction is in the first discontinuous section, one travel wheel on a side in which the first primary path exists is located between the travel rail pair installed along the first primary path along the paths spaced-apart direction, the one travel wheel being one of the first travel wheel pair and the second travel wheel pair that is located rearward of the other of the first travel wheel pair and the second travel wheel pair; and when one of the first travel wheel pair and the second travel wheel pair that is located rearward of the other of the first travel wheel pair and the second travel wheel pair along the vehicle body fore and aft direction is in the first discontinuous section, one travel wheel on a side in which the second primary path exists is located between the travel rail pair installed along the second primary path along the paths spaced-apart direction, the one travel wheel being one of the first travel wheel pair and the second travel wheel pair that is located forward of the other of the first travel wheel pair and the second travel wheel pair; wherein the second path is preferably formed to have such a length that, when the article transport vehicle travels along the second path from the third connecting portion to the fourth connecting portion; and when one of the first travel wheel pair and the second travel wheel pair that is located forward of the other of the first travel wheel pair and the second travel wheel pair along the vehicle body fore and aft direction is in the second discontinuous section, one travel wheel on a side in which the second primary path exists is located between the travel rail pair installed along the second primary path along the paths spaced-apart direction, the one travel wheel being one of the first travel wheel pair and the second travel wheel pair that is located rearward of the other of the first travel wheel pair and the second travel wheel pair; and when one of the first travel wheel pair and the second travel wheel pair that is located rearward of the other of the first travel wheel pair and the second travel wheel pair along the vehicle body fore and aft direction is in the second discontinuous section, one travel wheel on a side in which the first primary path exists is located between the travel rail pair installed along the first primary path along the paths spaced-apart direction, the one travel wheel being one of the first travel wheel pair and the second travel wheel pair that is located forward of the other of the first travel wheel pair and the second travel wheel pair; wherein, when the article transport vehicle travels along the first path from the first connecting portion to the second connecting portion, the first guide members preferably: support, in the first traveling state, only an auxiliary wheel of the pair of auxiliary wheels that is on a side in which the first primary path exists in the paths spaced-apart direction; and support, in the second traveling state, only an auxiliary wheel of the pair of auxiliary wheels that is on a side in which the second primary path exists in the paths spaced-apart direction, wherein, when the article transport vehicle travels along the second path from the third connecting portion to the fourth connecting portion, the second guide members preferably: support, in the third traveling state, only an auxiliary wheel of the pair of auxiliary wheels that is on a side in which the second primary path exists in the paths spaced-apart direction; and support, in the fourth traveling state, only an auxiliary wheel of the pair of auxiliary wheels that is on a side in which the first primary path exists in the paths spaced-apart direction.

In the first traveling state and the third traveling state, a condition occurs in which only one travel wheel of the right and left travel wheels of the travel wheel pair located rearward is supported whereas, in the second traveling state and the fourth traveling state, a condition occurs in which only one travel wheel of the right and left travel wheels of the travel wheel pair located forward is supported. Therefore, there is a possibility that the article transport vehicle may tilt either to the right or left in any one of the first through the fourth traveling states. Such tilting is reduced by virtue of the fact that the first guide members or the second guide members support the pair of the auxiliary wheels (or the guided members). To reduce tilting of the article transport vehicle, it is sufficient to support the auxiliary wheel (of the right and left auxiliary wheels of the auxiliary wheel pair) on the side that the article transport vehicle tilt toward. The first guide members and the second guide members are not configured to support both of the right and left auxiliary wheels of the auxiliary wheel pair but are configured to support only one of the right and left auxiliary wheels depending on which side the article transport vehicle tilts toward; therefore, the structure of the first guide members and the second guide members can be simplified. That is, tilting of the article transport vehicle to the right and left may be reduced by the first guide members and the second guide members while simplifying the structure of the first guide members and the second guide members.

In addition, guide surfaces of the first guide members and guide surfaces of the second guide members are preferably located at a higher position than the travel rail pair and at a lower position than the guided members.

With the arrangement described above, when the article transport vehicle is in any one of the first traveling state through the fourth traveling state, the first guide members or the second guide members which are located below the guided members can support one or more of the guided members; thus, tilting of the article transport vehicle from its horizontal state can be restricted. Incidentally, the article transport vehicle may include an article holding portion for holding an article, such that the article holding portion is located below the travel rail. In such a case, since the first guide members and the second guide members are provided at a higher position than the travel rails in the arrangement described above, it becomes easier, for example, to secure space through which the article holding portion moves; thus, the arrangement described above facilitates effective use of the space below the travel rail pair.

In addition, the guide surfaces of the first guide members and the guide surfaces of the second guide members are preferably located at a higher position than the first travel wheel pair and the second travel wheel pair of the article transport vehicle located in the crossing portion, wherein the article transport vehicle preferably includes raising and lowering actuators for raising and lowering the guided members, and wherein the raising and lowering actuators preferably raise and lower the guided members, to a lower position at which the guided members are fixed at a lower position than the first guide members and the second guide members, and to a higher position at which the guided members are fixed at a higher position than the first guide members and the second guide members.

With the arrangement described above, when the article transport vehicle is in any one of the first traveling state through the fourth traveling state, tilting of the article transport vehicle from its horizontal state can be reduced by moving the guided members to the upper position which is a higher position than the first guide members and the second guide members to have one or more of the guided members supported from below by the first guide members or the second guide members. On the other hand, by moving the guided members to the lower position when the article transport vehicle is not in any of the first traveling state through the fourth traveling state, any incident of the guided members contacting other objects, such as installed objects installed around the travel path, can be prevented.

In addition, the article transport vehicle preferably includes a travel portion in which the first travel wheel pair and the second travel wheel pair are spaced apart along the vehicle body fore and aft direction, an article holding portion located below the travel rail pair to hold an article, and a connecting portion which is located between two rail members that form the travel rail pair and which connects the travel portion and the article holding portion to each other.

When the article transport vehicle has such a structure, the crossing portion needs to have a discontinuous section in which the rail members are discontinuous because the connecting portion is located between the travel rail pair. Even when the rail members have such a discontinuous section, the crossing portion can have a simple structure while restricting the tilting of the article transport vehicle from its horizontal state when the article transport vehicle travels through the crossing portion, by virtue of the fact that the travel path is provided with the first guide members and the second guide members, and that the article transport vehicle is provided with the guided members.

In addition, the travel portion preferably includes a pair of right and left guide wheels which come into contact with, and rotate along, two respective inward surfaces through which the two rail members, that form the travel rail pair, face each other, and wherein the connecting portion is preferably located between the right and left guide wheels along a vehicle body lateral direction of the article transport vehicle.

By providing the guide wheels, the article transport vehicle can stably travel along the rail members as it is guided along the rail members. As described above, since the connecting portion is located between the pair of rail members, it is necessary to provide the crossing portion with discontinuous sections. And the guide wheels are not guided along the rail members in the discontinuous sections. However, even with such arrangement, the crossing portion can have a simple structure while restricting the tilting of the article transport vehicle from its horizontal state when the article transport vehicle travels through the crossing portion, by virtue of the fact that the travel path is provided with the first guide members and the second guide members, and that the article transport vehicle is provided with the guided members.

In addition, the travel portion preferably includes a branching guided member, wherein movable auxiliary rails are preferably provided in the crossing portion, the movable auxiliary rails preferably being capable of being switched between a first attitude for restricting movement of the branching guided member along a path width direction of the first path, and for guiding the branching guided member along the first path, and a second attitude for restricting movement of the branching guided member along a path width direction of the second path, and for guiding the branching guided member along the second path, wherein, provided as a pair of right and left guide wheel pair are preferably: a first guide wheel pair for which at least a part of a range in which the right and left guide wheel pair is located along the vehicle body fore and aft direction overlaps with a range over which the first travel wheel pair is located along the vehicle body fore and aft direction; and a second guide wheel pair for which at least a part of a range in which the right and left guide wheel pair is located along the vehicle body fore and aft direction overlaps with a range over which the second travel wheel pair is located along the vehicle body fore and aft direction, and wherein the branching guided member is preferably guided by the movable auxiliary rails in the first attitude when the article transport vehicle is in the first traveling state and in the second traveling state, and is guided by the movable auxiliary rails in the second attitude when the article transport vehicle is in the third traveling state and in the fourth traveling state.

With the arrangement described above, the two guide wheel pairs are provided such that at least a part of a range in which the guide wheel pair is located along the vehicle body fore and aft direction overlaps with a range over which the first travel wheel pair or the second travel wheel pair is located along the vehicle body fore and aft direction. Therefore the travel portion can have a small dimension along the vehicle body fore and aft direction. Here, in the first traveling state and in the third traveling state, a condition occurs in which the first guide wheel pair, which has at least a portion that overlaps with the range over in which the first travel wheel pair is located, is not guided by any rail member. Similarly, in the second traveling state and in the fourth traveling state, a condition occurs in which the second guide wheel pair, which has at least a portion that overlaps with the range over in which the second travel wheel pair is located, is not guided by any rail member. However, by virtue of the fact that the article transport vehicle is provided with the branching guided member, and that the branching portion is provided with the movable auxiliary rails, the article transport vehicle is guided by the movable auxiliary rails in the first attitude, when in the first traveling state and the second traveling state, and is guided by the movable auxiliary rails in the second attitude, when in the third traveling state and the fourth traveling state. Therefore, even when the article transport vehicle has the structure described above, the article transport vehicle can travel properly along the first path and the second path.

In addition, the first guide members and the second guide members are preferably installed at the same vertical position as the movable auxiliary rails With the arrangement described above, since the first guide members and the second guide members are installed at the same vertical position as the movable auxiliary rails, the movable auxiliary rails, the first guide members, and the second guide members can be installed in smaller space in the vertical direction compared with the case in which the movable auxiliary rails are installed at a different vertical position from the first guide members and the second guide members.

What is claimed is:

1. An article transport facility comprising: an article transport vehicle configured to travel along travel paths to transport an article;

a travel rail pair on which the article transport vehicle travels, the travel rail pair including two rail members arranged in parallel and spaced apart from each other at a constant distance along a width direction which is perpendicular to a direction along which a corresponding travel path extends;

first guide members whose positions are fixed with respect to the travel rail pair;

second guide members whose positions are fixed with respect to the travel rail pair;

wherein the article transport vehicle includes a first travel wheel pair including a pair of right and left travel wheels which roll on travel surfaces of the travel rail pair, a second travel wheel pair located on one side with respect to the first travel wheel pair along a vehicle body fore and aft direction which is along a travel direction of the article transport vehicle, the second travel wheel pair including a pair of right and left travel wheels which roll on the travel surfaces of the travel rail pair, guided members whose vertical positions can be fixed with respect to the first travel wheel pair and the second travel wheel pair, wherein the travel paths include a first path, a second path that crosses the first path, and a crossing portion in which the first path and the second path cross each other, wherein a first travel rail pair which is the travel rail pair provided along the first path has, in the crossing portion, a first discontinuous section in which the rail members are discontinuous, wherein a second travel rail pair which is the travel rail pair provided along the second path has, in the crossing portion, a second discontinuous section in which the rail members are discontinuous, wherein the first guide members allow movement of the guided members in the travel direction and restrict vertical movement of one or more of the guided members, in a first traveling state in which the first travel wheel pair is in the first discontinuous section and in a second traveling state in which the second travel wheel pair is in the first discontinuous section, when the article transport vehicle travels through the crossing portion along the first path, and wherein the second guide members allow movement of the guided members in the travel direction and restrict vertical movement of one or more of the guided members, in a third traveling state in which the first travel wheel pair is in the second discontinuous section and in a fourth traveling state in which the second travel wheel pair is in the second discontinuous section, when the article transport vehicle travels through the crossing portion along the second path.

2. The article transport facility as defined in claim 1, wherein the guided members are a pair of right and left auxiliary wheels which rotate about one or more axes extending along a vehicle body lateral direction of the article transport vehicle, and wherein the pair of auxiliary wheels are located at a middle position between the first travel wheel pair and the second travel wheel pair along the vehicle body fore and aft direction.

3. The article transport facility as defined in claim 2, wherein, in addition to the first path and the second path, the travel paths include a first primary path, and a second primary path which extends along the first primary path, wherein the crossing portion is located between the first primary path and the second primary path along a paths spaced-apart direction in plan view, with the paths spaced-apart direction being defined to be a direction along which the first primary path and the second primary path are spaced apart from each other in plan view, wherein the first path is connected to a first connecting portion of the first primary path and to a second connecting portion of the second primary path, wherein the second path is connected to a third connecting portion of the second primary path and to a fourth connecting portion of the first primary path, wherein the first path is formed to have such a length that, when the article transport vehicle travels along the first path from the first connecting portion to the second connecting portion; and when one of the first travel wheel pair and the second travel wheel pair that is located forward of the other of the first travel wheel pair and the second travel wheel pair along the vehicle body fore and aft direction is in the first discontinuous section, one travel wheel on a side in which the first primary path exists is located between the travel rail pair installed along the first primary path along the paths spaced-apart direction, the one travel wheel being one of the first travel wheel pair and the second travel wheel pair that is located rearward of the other of the first travel wheel pair and the second travel wheel pair; and when one of the first travel wheel pair and the second travel wheel pair that is located rearward of the other of the first travel wheel pair and the second travel wheel pair along the vehicle body fore and aft direction is in the first discontinuous section, one travel wheel on a side in which the second primary path exists is located between the travel rail pair installed along the second primary path along the paths spaced-apart direction, the one travel wheel being one of the first travel wheel pair and the second travel wheel pair that is located forward of the other of the first travel wheel pair and the second travel wheel pair, wherein the second path is formed to have such a length that, when the article transport vehicle travels along the second path from the third connecting portion to the fourth connecting portion; and when one of the first travel wheel pair and the second travel wheel pair that is located forward of the other of the first travel wheel pair and the second travel wheel pair along the vehicle body fore and aft direction is in the second discontinuous section, one travel wheel on a side in which the second primary path exists is located between the travel rail pair installed along the second primary path along the paths spaced-apart direction, the one travel wheel being one of the first travel wheel pair and the second travel wheel pair that is located rearward of the other of the first travel wheel pair and the second travel wheel pair; and when one of the first travel wheel pair and the second travel wheel pair that is located rearward of the other of the first travel wheel pair and the second travel wheel pair along the vehicle body fore and aft direction is in the second discontinuous section, one travel wheel on a side in which the first primary path exists is located between the travel rail pair installed along the first primary path along the paths spaced-apart direction, the one travel wheel being one of the first travel wheel pair and the second travel wheel pair that is located forward of the other of the first travel wheel pair and the second travel wheel pair, wherein, when the article transport vehicle travels along the first path from the first connecting portion to the second connecting portion, the first guide members: support, in the first traveling state, only an auxiliary wheel of the pair of auxiliary wheels that is on a side in which the first primary path exists in the paths spaced-apart direction; and support, in the second traveling state, only an auxiliary wheel of the pair of auxiliary wheels that is on a side in which the second primary path exists in the paths spaced-apart direction, and wherein, when the article transport vehicle travels along the second path from the third connecting portion to the fourth connecting portion, the second guide members: support, in the third traveling state, only an auxiliary wheel of the pair of auxiliary wheels that is on a side in which the second primary path exists in the paths spaced-apart direction; and support, in the fourth traveling state, only an auxiliary wheel of the pair of auxiliary wheels that is on a side in which the first primary path exists in the paths spaced-apart direction.

4. The article transport facility as defined in claim 1, wherein guide surfaces of the first guide members and guide surfaces of the second guide members are located at a higher position than the travel rail pair and at a lower position than the guided members.

5. The article transport facility as defined in claim 4, wherein the guide surfaces of the first guide members and the guide surfaces of the second guide members are located at a higher position than the first travel wheel pair and the second travel wheel pair of the article transport vehicle located in the crossing portion, wherein the article transport vehicle includes raising and lowering actuators for raising and lowering the guided members, and wherein the raising and lowering actuators raise and lower the guided members, to a lower position at which the guided members are fixed at a lower position than the first guide members and the second guide members, and to a higher position at which the guided members are fixed at a higher position than the first guide members and the second guide members.

6. The article transport facility as defined in claim 1, wherein the article transport vehicle includes a travel portion in which the first travel wheel pair and the second travel wheel pair are spaced apart along the vehicle body fore and aft direction, an article holding portion located below the travel rail pair to hold an article, and a connecting portion which is located between two rail members that form the travel rail pair and which connects the travel portion and the article holding portion to each other.

7. The article transport facility as defined in claim 6, wherein the travel portion includes a pair of right and left guide wheels which come into contact with, and rotate along, two respective inward surfaces through which the two rail members, that form the travel rail pair, face each other, and wherein the connecting portion is located between the right and left guide wheels along a vehicle body lateral direction of the article transport vehicle.

8. The article transport facility as defined in claim 7, wherein the travel portion includes a branching guided member, wherein movable auxiliary rails are provided in the crossing portion, the movable auxiliary rails being capable of being switched between a first attitude for restricting movement of the branching guided member along a path width direction of the first path, and for guiding the branching guided member along the first path, and a second attitude for restricting movement of the branching guided member along a path width direction of the second path, and for guiding the branching guided member along the second path, wherein, provided as a pair of right and left guide wheel pair are: a first guide wheel pair for which at least a part of a range in which the right and left guide wheel pair is located along the vehicle body fore and aft direction overlaps with a range over which the first travel wheel pair is located along the vehicle body fore and aft direction; and a second guide wheel pair for which at least a part of a range in which the right and left guide wheel pair is located along the vehicle body fore and aft direction overlaps with a range over which the second travel wheel pair is located along the vehicle body fore and aft direction, and wherein the branching guided member is guided by the movable auxiliary rails in the first attitude when the article transport vehicle is in the first traveling state and in the second traveling state, and is guided by the movable auxiliary rails in the second attitude when the article transport vehicle is in the third traveling state and in the fourth traveling state.

9. The article transport facility as defined in claim 8, wherein the first guide members and the second guide members are installed at the same height as the movable auxiliary rails.

10. The article transport facility as defined in claim 3, wherein guide surfaces of the first guide members and guide surfaces of the second guide members are located at a higher position than the travel rail pair and at a lower position than the guided members.

11. The article transport facility as defined in claim 10, wherein the guide surfaces of the first guide members and the guide surfaces of the second guide members are located at a higher position than the first travel wheel pair and the second travel wheel pair of the article transport vehicle located in the crossing portion, wherein the article transport vehicle includes raising and lowering actuators for raising and lowering the guided members, and wherein the raising and lowering actuators raise and lower the guided members, to a lower position at which the guided members are fixed at a lower position than the first guide members and the second guide members, and to a higher position at which the guided members are fixed at a higher position than the first guide members and the second guide members.

12. The article transport facility as defined in claim 11, wherein the article transport vehicle includes a travel portion in which the first travel wheel pair and the second travel wheel pair are spaced apart along the vehicle body fore and aft direction, an article holding portion located below the travel rail pair to hold an article, and a connecting portion which is located between two rail members that form the travel rail pair and which connects the travel portion and the article holding portion to each other.

13. The article transport facility as defined in claim 12, wherein the travel portion includes a pair of right and left guide wheels which come into contact with, and rotate along, two respective inward surfaces through which the two rail members, that form the travel rail pair, face each other, and wherein the connecting portion is located between the right and left guide wheels along a vehicle body lateral direction of the article transport vehicle.

14. The article transport facility as defined in claim 13, wherein the travel portion includes a branching guided member, wherein movable auxiliary rails are provided in the crossing portion, the movable auxiliary rails being capable of being switched between a first attitude for restricting movement of the branching guided member along a path width direction of the first path, and for guiding the branching guided member along the first path, and a second attitude for restricting movement of the branching guided member along a path width direction of the second path, and for guiding the branching guided member along the second path, wherein, provided as a pair of right and left guide wheel pair are: a first guide wheel pair for which at least a part of a range in which the right and left guide wheel pair is located along the vehicle body fore and aft direction overlaps with a range over which the first travel wheel pair is located along the vehicle body fore and aft direction; and a second guide wheel pair for which at least a part of a range in which the right and left guide wheel pair is located along the vehicle body fore and aft direction overlaps with a range over which the second travel wheel pair is located along the vehicle body fore and aft direction, and wherein the branching guided member is guided by the movable auxiliary rails in the first attitude when the article transport vehicle is in the first traveling state and in the second traveling state, and is guided by the movable auxiliary rails in the second attitude when the article transport vehicle is in the third traveling state and in the fourth traveling state.

15. The article transport facility as defined in claim 14, wherein the first guide members and the second guide members are installed at the same height as the movable auxiliary rails.

16. An article transport facility comprising:

an article transport vehicle configured to travel along travel paths to transport an article;

a travel rail pair on which the article transport vehicle travels, the travel rail pair including two rail members arranged in parallel and spaced apart from each other at a constant distance along a width direction which is perpendicular to a direction along which a corresponding travel path extends;

first guide members whose positions are fixed with respect to the travel rail pair;

second guide members whose positions are fixed with respect to the travel rail pair;

wherein the article transport vehicle includes a first travel wheel pair including a pair of right and left travel wheels which roll on travel surfaces of the travel rail pair, a second travel wheel pair located on one side with respect to the first travel wheel pair along a vehicle body fore and aft direction which is along a travel direction of the article transport vehicle, the second travel wheel pair including a pair of right and left travel wheels which roll on the travel surfaces of the travel rail pair, guided members whose vertical positions can be fixed with respect to the first travel wheel pair and the second travel wheel pair, wherein the travel paths include a first path, a second path that crosses the first path, and a crossing portion in which the first path and the second path cross each other, wherein a first travel rail pair which is the travel rail pair provided along the first path has, in the crossing portion, a first discontinuous section in which the rail members are discontinuous, wherein a second travel rail pair which is the travel rail pair provided along the second path has, in the crossing portion, a second discontinuous section in which the rail members are discontinuous, wherein the first guide members allow movement of the guided members in the travel direction on a guide surface of the first guide members and restrict downward movement of one or more of the guided members by supporting the guided members from below by the guide surface, in a first traveling state in which the first travel wheel pair is in the first discontinuous section and in a second traveling state in which the second travel wheel pair is in the first discontinuous section, when the article transport vehicle travels through the crossing portion along the first path, and wherein the second guide members allow movement of the guided members in the travel direction on a guide surface of the second guide members and restrict downward movement of one or more of the guided members by supporting the guided members from below by the guide surface, in a third traveling state in which the first travel wheel pair is in the second discontinuous section and in a fourth traveling state in which the second travel wheel pair is in the second discontinuous section, when the article transport vehicle travels through the crossing portion along the second path.

* * * * *